US011466686B2

(12) United States Patent
Lee et al.

(10) Patent No.: US 11,466,686 B2
(45) Date of Patent: Oct. 11, 2022

(54) ROTARY COMPRESSOR

(71) Applicant: LG ELECTRONICS INC., Seoul (KR)

(72) Inventors: Jingyu Lee, Seoul (KR); Sangmin Na, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/313,107

(22) Filed: May 6, 2021

(65) Prior Publication Data

US 2021/0381511 A1 Dec. 9, 2021

(30) Foreign Application Priority Data

Jun. 5, 2020 (KR) ..... 10-2020-0068545

(51) Int. Cl.
*F03C 2/00* (2006.01)
*F03C 4/00* (2006.01)
(Continued)

(52) U.S. Cl.
CPC ..... *F04C 18/3443* (2013.01); *F04C 15/0088* (2013.01); *F01C 21/0836* (2013.01); *F04C 23/008* (2013.01)

(58) Field of Classification Search
CPC .. F04C 18/324; F04C 18/344; F04C 18/3443; F04C 18/356; F04C 18/3564;
(Continued)

(56) References Cited

U.S. PATENT DOCUMENTS 5,667,372 A * 9/1997 Hwang ..... F04C 29/028 418/94
10,260,504 B2 4/2019 Zhou et al.
(Continued)

FOREIGN PATENT DOCUMENTS

EP 3 309 400 4/2018
EP 3 517 783 7/2019
(Continued)

OTHER PUBLICATIONS

Korean Office Action issued in Application No. 10-2020-0068545 dated Jul. 20, 2021.
(Continued)

*Primary Examiner* — Theresa Trieu
(74) *Attorney, Agent, or Firm* — Ked & Associates

(57) ABSTRACT

A rotary compressor is provided that may include a roller slidingly coupled to an eccentric portion of a rotational shaft so as to be moved along an inner circumferential surface of a cylinder by the rotational shaft, and a vane slidingly coupled to the cylinder so as to divide the compression space into a plurality of compression chambers. An oil supply groove may be formed on an outer circumferential surface of the eccentric portion or an inner circumferential surface of the roller that faces the outer circumferential surface of the eccentric portion, and a depth of the oil supply groove may decrease as a distance in a circumferential direction from the second oil supply hole increases. Accordingly, an amount of oil supplied between the eccentric portion and the roller may be increased to thereby reduce friction loss.

20 Claims, 13 Drawing Sheets

(51) Int. Cl.

| | |
|---|---|
| ***F04C 29/02*** | (2006.01) |
| ***F04C 29/04*** | (2006.01) |
| ***F04C 18/344*** | (2006.01) |
| ***F04C 15/00*** | (2006.01) |
| *F01C 21/08* | (2006.01) |
| *F04C 23/00* | (2006.01) |

(58) Field of Classification Search
CPC ..... F04C 29/02; F04C 29/023; F04C 29/028; F04C 23/008; F01C 21/0836
See application file for complete search history.

(56) References Cited

U.S. PATENT DOCUMENTS

| | | | | |
|---|---|---|---|---|
| 2013/0101454 | A1* | 4/2013 | Karino | F04C 18/324 418/63 |
| 2016/0040673 | A1 | 2/2016 | Lee et al. | |
| 2017/0275996 | A1* | 9/2017 | Cho | F01C 21/0809 |
| 2020/0378386 | A1* | 12/2020 | Lee | F04C 18/324 |
| 2021/0025389 | A1* | 1/2021 | Kim | F04C 18/324 |

FOREIGN PATENT DOCUMENTS

| | | |
|---|---|---|
| JP | 05-340370 | 12/1993 |
| JP | 2010-255594 | 11/2010 |
| KR | 10-2016-0034071 | 3/2016 |
| KR | 10-1983495 | 8/2019 |

OTHER PUBLICATIONS

European Search Report issued in Application No. 21173351.4 dated Aug. 3, 2021.

* cited by examiner

ROTARY COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2020-0068545, filed in Korea on Jun. 5, 2020, the contents of which are incorporated by reference herein in its entirety.

BACKGROUND

1. Field

A rotary compressor is disclosed herein.

2. Background

A rotary compressor compresses a refrigerant using a roller that performs an orbiting motion in a compression space of a cylinder and a vane in contact with an outer circumferential surface of the roller to divide the compression space of the cylinder into a plurality of spaces. The rotary compressor may be classified into a rolling roller type and a hinge vane type depending on whether or not a roller and a vane are coupled to each other. As for the rolling roller type rotary compressor, a vane is detachably coupled to a roller, allowing the roller to rotate while sliding along an eccentric portion. In the hinge vane type rotary compressor, a vane is hinged to a roller, enabling the roller to slide with respect to an eccentric portion while suppressing rotation of the roller.

In both the rolling roller type and hinge vane type rotary compressors, as the roller is slidingly coupled to the eccentric portion, a slip phenomenon in which the roller slides with respect to the eccentric portion due to pressure of a compression space during compression may occur. For this reason, conventionally, oil is supplied between an outer circumferential surface of the eccentric portion and an inner circumferential surface of the roller to form an oil film.

However, in the related art rotary compressor, as the eccentric portion and the roller are closely coupled to each other with a fine or minute clearance (or gap), oil may not provide sufficient lubrication between the outer circumferential surface of the eccentric portion and the inner circumferential surface of the roller.

Korean Registered Patent No. 10-1983495 (hereinafter "Patent Document 1"), which is hereby incorporated by reference, discloses a technique in which a plurality of oil supply grooves is formed along an outer circumferential surface of an eccentric portion so that a specific amount of oil is filled in each of the plurality of oil supply grooves to lubricate the eccentric portion and a roller. In this case, oil supply holes are respectively formed in the plurality of oil supply grooves, allowing oil to be introduced into each of the plurality of oil supply grooves.

U.S. Registered Pat. No. 10,260,504 B2 (hereinafter "Patent Document 2"), which is hereby incorporated by reference, discloses a technique in which an oil supply hole is formed in a manner of communicating with an oil supply groove. In this case, the oil supply groove is formed long in a circumferential direction to thereby reduce a friction area.

BRIEF DESCRIPTION OF THE DRAWINGS

Embodiments will be described in detail with reference to the following drawings in which like reference numerals refer to like elements, and wherein.

DETAILED DESCRIPTION

Hereinafter, a rotary compressor according to embodiments will be described with reference to the accompanying drawings. Rotary compressors may be classified into a single-type rotary compressor and a double-type rotary compressor according to a number of cylinders. The rotary compressors may also be classified into a vane separation type rotary compressor and a hinge vane type rotary compressor depending on whether or not a vane and a roller are coupled to each other. Herein, a single and hinge vane type rotary compressor will be used as an example; however, embodiments may be equally applied to a double-type rotary compressor and a vane separation type rotary compressor.

Figure 1:
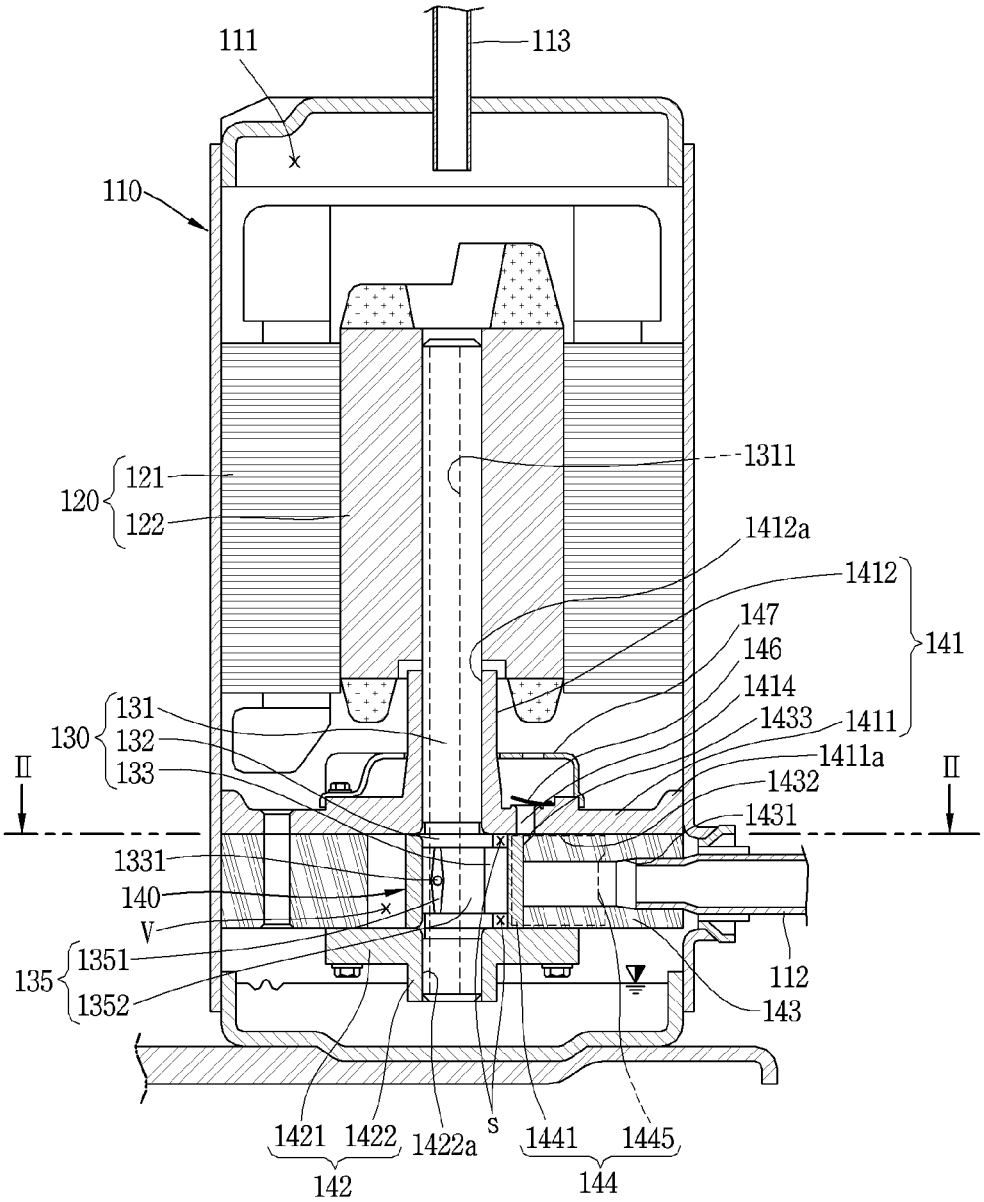
FIG. 1 is a longitudinal cross-sectional view of a rotary compressor according to an embodiment.
Figure 2:
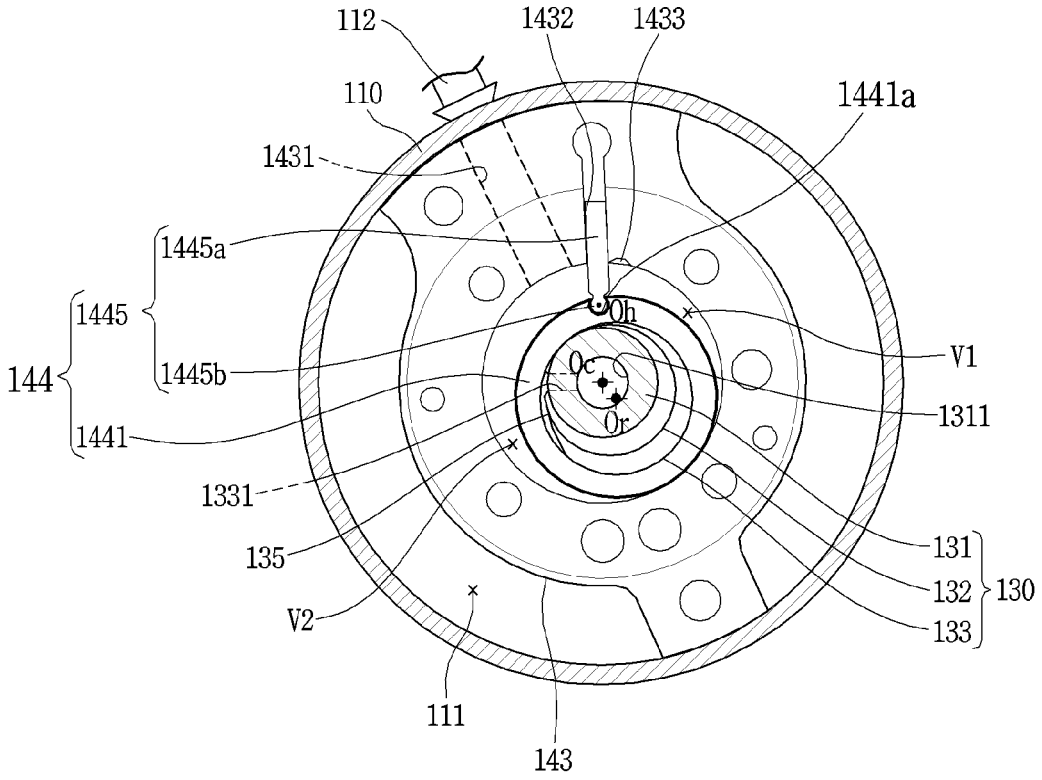
FIG. 2 is a cross-sectional view, taken along line II-II of FIG. 1.

FIG. 1 is a longitudinal cross-sectional view of a rotary compressor according to an embodiment. FIG. 2 is a cross-sectional view, taken along the line II-II in FIG. 1.

Referring to FIGS. 1 and 2, in the rotary compressor according to this embodiment, a motor unit (motor) 120 is installed in an inner space 111 of a casing 110, and a compression unit 140 that is disposed below and mechanically connected to the motor unit 120 by a rotational shaft 130 is installed in the inner space 111 of the casing 110.

The casing 110 has a cylindrical shape and is disposed in a longitudinal direction. However, in some cases, the casing 110 may be disposed in a transverse direction.

The motor unit 120 may include a stator 121 that is press-fitted to an inner circumferential surface of the casing 110, and a rotor 122 that is rotatably inserted into the stator 121. The rotational shaft 130 may be press-fitted to the rotor 122, for example.

The rotational shaft 130 may include a shaft portion 131, a bearing portion 132, and an eccentric portion 133. The shaft portion 131 may extend in an axial direction so as to allow the rotor 122 to be coupled thereto, and may be coupled to a main bearing plate 141 and a sub bearing plate 142 described hereinafter in a penetrating manner. Accordingly, the shaft portion 131 may be supported on the main bearing plate 141 and the sub bearing plate 142 in a radial direction.

The bearing portion 132 may extend from an outer circumferential surface of the shaft portion 131 to be eccentric in the radial direction, so as to be disposed between the main bearing plate 141 and the sub bearing plate 142, which will be described hereinafter, inside of a cylinder 143. Accordingly, the bearing portion 132 may be axially supported by the main bearing plate 141 and the sub bearing plate 142 described hereinafter.

The eccentric portion 133 may extend from the bearing portion 132 to be eccentric in the same direction as the bearing portion 131, namely, in the radial direction, so as to be disposed inside of the cylinder 143 described hereinafter. The eccentric portion 133 may be slidingly (or slidably) coupled to a roller 1441 of a vane roller 144 described hereinafter. The eccentric portion 133 will be described hereinafter.

A first oil supply hole 1311 may be formed through both axial ends of the shaft portion 131, and a second oil supply hole 1331 that penetrates from the first oil supply hole 1311 to an outer circumferential surface of the eccentric portion 133 may be formed on the eccentric portion 133. The second oil supply hole 1331 will be described hereinafter together with the eccentric portion 133.

Hereinafter, the compression unit will be described.

In some embodiments, the compression unit 140 may include main bearing plate (hereinafter, main bearing) 141, sub bearing plate (hereinafter, sub bearing) 142, cylinder 143, and vane roller 144. The main bearing 141 and the sub bearing 142 may be respectively provided on both sides in the axial direction with the cylinder 143 interposed therebetween, so as to form a compression space V inside of the cylinder 143.

In addition, the main bearing 141 and the sub bearing 142 may radially support the rotational shaft 130 that penetrates through the cylinder 143. The vane roller 144 may be coupled to the eccentric portion 133 of the rotational shaft 130, so as to compress a refrigerant while performing an orbiting motion in the cylinder 143.

The main bearing 141 may be provided with a main plate portion 1411 having a disk (or disc) shape. A side wall portion (side wall) 1411*a* having an annular shape may be formed at an edge of the main plate 1411 so as to, for example, be shrink-fitted or welded to an inner circumferential surface of the casing 110. A main bearing portion 1412 may be provided at a central (or middle) portion of the main plate portion 1411 in a manner of protruding upward, namely toward the motor unit 120. A main shaft-receiving hole 1412*a* may be formed through the main bearing portion 1412 so as to allow the rotational shaft 130 to be inserted and supported.

The sub bearing 142 may be provided with a sub plate portion 1421 having a disk shape, so as to be coupled to the main bearing 141 by, for example, a bolt together with the cylinder 143. In a case in which the cylinder 143 is fixed to the casing 110, the main bearing 141 and the sub bearing 142 may be coupled to the cylinder 143 by, for example, bolts, respectively. In a case in which the sub bearing 142 is fixed to the casing 110, the cylinder 143 and the main bearing 110 may be coupled to the sub bearing 142 by, for example, a bolt.

A sub bearing portion 1422 may be provided at a central portion of the sub plate 1421 in a manner of protruding downward, namely toward a bottom surface of the casing 110, and a sub shaft-receiving hole 1422*a* may be formed through the sub bearing portion 1422 on the same axis as the main shaft-receiving hole 1412*a*. A lower end of the rotational shaft 130 may be supported by the sub shaft-receiving hole 1422*a*.

The cylinder 143 may have an annular shape. An inner circumferential surface of the cylinder 143 may be formed in a circular shape with a constant inner diameter. The inner diameter of the cylinder 143 may be greater than an outer diameter of the roller 1441. Accordingly, the compression space V may be formed between the inner circumferential surface of the cylinder 143 and an outer circumferential surface of the roller 1441.

For example, the inner circumferential surface of the cylinder 143 may define an outer wall surface of the compression space V, the outer circumferential surface of the roller 1441 may define an inner wall surface of the compression space V, and a vane 1445 may define a side wall surface of the compression space V. As the roller 1441 performs an orbiting motion, the outer wall surface of the compression space V may define a fixed wall, whereas the inner wall and side wall surfaces of the compression space V may define variable walls whose positions are variable.

An inlet port 1431 may be provided at the cylinder 143. A vane slot 1432 may be provided at one side in a circumferential direction of the inlet port 1431, and a discharge guide groove 1433 may be formed at an opposite side of the inlet port 131 with the vane slot 1432 interposed therebetween.

The inlet port 1431 may radially penetrate from an outer circumferential surface to an inner circumferential surface of the cylinder 143. A suction (or intake) pipe 112 that penetrates through the casing 110 may be connected to an outer circumferential side of the inlet port 1431. Accordingly, a refrigerant may be suctioned into the compression space V of the cylinder 143 through the suction pipe 112 and the inlet port 1431.

The inlet port 1431, in general, may have a circular cross section. However, in some cases, it may have an elliptical cross section, or angular (or angled) cross section. In this embodiment, description will be given of an example in which the inlet port 1431 has the circular cross section. Therefore, an inner diameter of the inlet port 131 of this embodiment is constant.

The vane slot 132 may extend lengthwise on the inner circumferential surface of the cylinder 143 in a direction toward the outer circumferential surface thereof. An inner circumferential side of the vane slot 1432 may be open, and an outer circumferential side thereof closed or open so as to be blocked (or covered) by the inner circumferential surface of the casing 110.

The vane slot 1432 may have a width substantially equal to a thickness or width of the vane 145 so as to allow the vane 1445 of the vane roller 144, which will be described hereinafter, to slide. Accordingly, both side (or lateral) surfaces of the vane 1445 may be supported by both inner wall surfaces of the vane slot 1432, allowing the vane 1445 to slide in a substantially linear or straight manner.

The discharge guide groove 1433 having a hemispherical shape may be formed by, for example, chamfering inner edges of the cylinder 143. The discharge guide groove 1433 may serve to guide a refrigerant compressed in the compression space V of the cylinder 143 to an outlet port 1414 of the main bearing 141. Accordingly, the discharge guide groove 1433 may be provided at a position that overlaps the outlet port 1414 in axial projection, so as to communicate with the outlet port 1414.

However, as the discharge guide groove 1433 causes dead volume, the discharge guide groove 1433 may not be provided. Or the discharge guide groove 1433 with a minimum dead volume may be provided.

As described above, the vane roller 144 may include the roller 1441 and the vane 1445. The roller 1441 and the vane 1445 may be formed as a single body, or coupled in a manner of enabling relative movement. In this embodiment, an example in which the roller and the vane are rotatably coupled to each other will be mainly discussed.

The roller 1441 may have a cylindrical shape. The roller 1441 may be formed in a circular shape with inner and outer circumferential surfaces having a same center. In some embodiments, the roller 1441 may have a circular shape with inner and outer circumferential surfaces having different centers.

An axial height of the roller 1441 may be substantially equal to a height of the inner circumferential surface of the cylinder 143. However, as the roller 1441 slides with respect to the main bearing 141 and the sub bearing 142, the axial height of the roller 1441 may be slightly less than the height of the inner circumferential surface of the cylinder 143.

In addition, heights of the inner and outer circumferential surfaces of the roller 1441 are substantially the same. Accordingly, both axial cross sections that connect the inner and outer circumferential surfaces of the roller 1441 define sealing surfaces, respectively. These sealing surfaces are perpendicular to the inner circumferential surface of the roller 1441 or the outer circumferential surface of the roller 1441. However, an edge between the inner circumferential surface of the roller 1441 and each sealing surface, or an edge between the outer circumferential surface of the roller 1441 and each sealing surface may be slightly inclined or curved.

The roller 1441 may be rotatably inserted into the eccentric portion 133 of the rotational shaft 130 to be coupled thereto, and the vane 1445 may be slidingly coupled to the vane slot 1432 of the cylinder 143 and be hinged to the outer circumferential surface of the roller 1441. Accordingly, when the rotational shaft 130 rotates, the roller 1441 performs an orbiting motion inside of the cylinder 143 by the eccentric portion 133, and the vane 1445 performs a reciprocating motion in a state of being coupled to the roller 1441.

However, the roller 1441 may be located at a same center as the cylinder 143. In some embodiments, the roller 1441 may be slightly eccentric from the center of the cylinder 143. For example, when a center of the roller 1441 coincides with the center of the cylinder 143, a gap or clearance (hereinafter, "allowable clearance") between the inner circumferential surface of the cylinder 143 and the outer circumferential surface of the roller 1441 may be almost constant along the circumferential direction. Then, a compression stroke may be started when a contact point at which the inner circumferential surface of the cylinder 143 is most adjacent to the outer circumferential surface of the roller 1441 reaches a circumferential end of the inlet port 1431. This compression stroke may be uniformly performed up to a discharge stroke.

However, when the center of the roller 1441 and the center of the cylinder 143 coincide with each other, the pressure of a compression chamber gradually rises, and thus, refrigerant leakage may occur during the process of reaching the discharge stroke due to a pressure difference between a preceding compression chamber and a following compression chamber.

As such, the center of the roller 1441 may be eccentric with respect to the center of the cylinder 143. For example, a center Or of the roller 1441 may be eccentric with respect to a center Oc of the cylinder 143 (coaxial with an axial center) in a direction close to the outlet port 1414. Accordingly, an allowable clearance at a side at which the inlet port 1431 is located with respect to a virtual line that connects a center Oh of a hinge groove 1441*a* and the axial center Oc may be wide, that is, approximately 40 to 50 μm, and an allowable clearance at an opposite side at which the outlet port 114 may be located is narrow, that is, approximately 10 to 20 μm.

Then, even when the allowable clearance is wide in the initial compression stroke, a pressure difference between a preceding compression chamber V1 and a following compression chamber V2 is not significant. Thus, an amount of refrigerant leakage between the compression chambers V1 and V2 is small. Further, even when the pressure difference between the preceding compression chamber V1 and the following compression chamber V2 increases as pressure of the preceding compression chamber V1 gradually increases to reach the discharge stroke, the relatively narrow allowable clearance allows refrigerant leakage between the compression chambers V1 and V2 to be suppressed.

The roller 1441 may have an annular shape with an inner diameter that allows the inner circumferential surface thereof to be brought into sliding contact with an outer circumferential surface of the eccentric portion 133 of the rotational shaft 130. The roller 1441 may have a radial width (thickness) enough to secure a sealing distance from the hinge groove 1441*a* described hereinafter.

In addition, a thickness of the roller 1441 may be constant along the circumferential direction, or may vary in some embodiments. For example, the inner circumferential surface of the roller 1441 may have an elliptical shape.

However, in order to minimize a load when the rotational shaft 130 rotates, the inner and outer circumferential surfaces of the roller 1441 may be formed in a circular shape having the same center, and the radial thickness of the roller 1441 may be constant along the circumferential direction.

One hinge groove 1441*a* in which a hinge protrusion 1445*b* of the vane 1445 described hereinafter may be rotatably inserted may be formed on the outer circumferential surface of the roller 1441. An outer circumferential surface of the hinge groove 1441*a* may have an open arcuate shape.

An inner diameter of the hinge groove 1441*a* may be greater than an outer diameter of the hinge protrusion 1445*b*, and may have a size sufficient to allow the hinge protrusion 1445*b* to slide without being separated therefrom in an inserted state.

The vane 1445 may include a sliding portion 1445*a* and the hinge protrusion 1445*b*. The sliding portion 1445*a* may be a portion that defines a vane body, and have a flat-plate shape with a predetermined length and thickness. For example, the sliding portion 1445*a* may have a shape of a rectangular hexagon as a whole. In addition, the sliding portion 1445*a* may have a length sufficient for the vane 1445 to remain in the vane slot 132 even when the roller 1441 is completely moved to an opposite side of the vane slot 1432.

The hinge protrusion 1445*b* may extend from a front end of the sliding portion 1445*a* that faces the roller 1441. The hinge protrusion 1445*b* may have a cross-sectional area sufficient to be inserted into the hinge groove 1441*a* and rotated. The hinge protrusion 1445*b* may have a semi-circular shape, or a substantially circular cross-sectional shape excluding a connecting portion so as to correspond to the hinge groove 1441*a*.

In the drawings, unexplained reference numerals 113, 146, and 147 denote a discharge pipe, a discharge valve, and a discharge muffler, respectively.

The rotary compressor according to this embodiment may operate as follows.

When power is applied to the motor unit 120, the rotor 122 of the motor unit 120 rotates, allowing the rotational shaft 130 to be rotated. Then, as the roller 1441 of the vane roller 144 which is coupled to the eccentric portion 133 of the rotational shaft 130 performs an orbiting motion, refrigerant is introduced into the compression space V of the cylinder 143.

This refrigerant is pressurized or compressed by the roller 1441 and the vane 1445 of the vane roller 144, causes the discharge valve 146 provided at the main bearing 141 to open, is discharged into an inner space of the discharge muffler 147 through the outlet port 1414, and is then discharged into the inner space 111 of the casing 110. Such series of processes are repeated.

Figure 3:
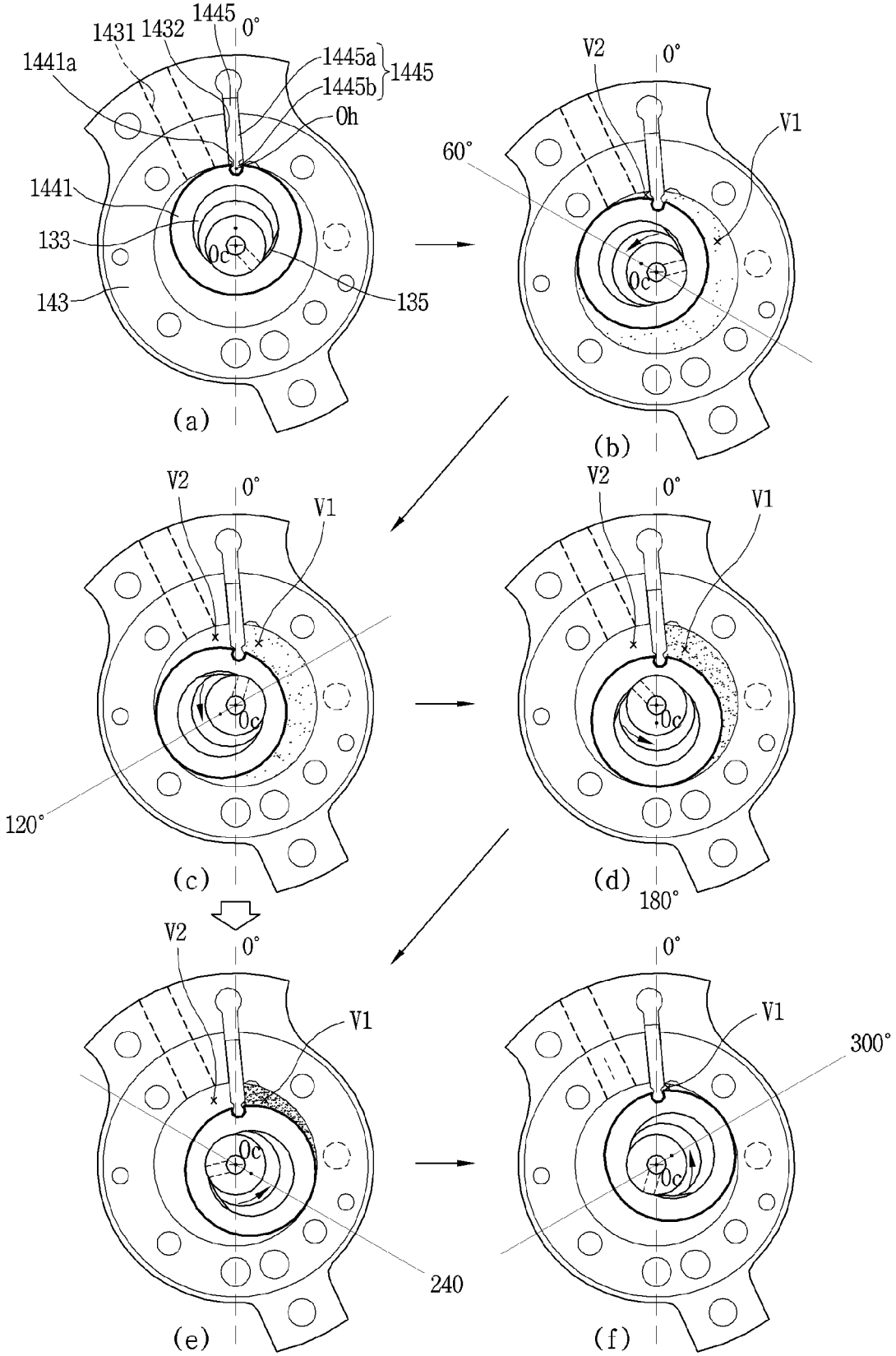
FIG. 3 is a schematic view illustrating changes in position of a vane roller according to a rotational angle of a rotational shaft in the rotary compressor according to an embodiment.

Positions (or locations) of the roller 1441 and the vane 1445 may be changed according to a rotational angle of the rotational shaft 130. FIG. 3 is a schematic view illustrating changes in position of a vane roller according to a rotational angle of a rotational shaft in a rotary compressor according to an embodiment.

First, in the drawing, from a position at which the eccentric portion 133 of the rotational shaft 130 faces the vane slot 1432, a virtual line that passes through axial center Oc of the rotational shaft 130 (coaxial with the axial center of the cylinder) and center Oh of the hinge groove 1441*a* is at 0°. This corresponds to (a) of FIG. 3. At this time, the hinge groove 1441*a* of the roller 1441 is almost in contact with the inner circumferential surface of the cylinder 143, allowing the vane 1445 to be drawn (or introduced) into the vane slot 132.

Next, in (b) of FIG. 3, the rotational shaft 130 is rotated approximately 60°, and in (c) of FIG. 3, the rotational shaft 130 is rotated about 120°. In these states, the hinge groove 1441*a* of the roller 1441 is spaced apart from the inner circumferential surface of the cylinder 143, and a part or portion of the vane 1445 is pulled or drawn out from the vane slot 1432. At this time, the following compression chamber V2 forms a suction chamber, allowing refrigerant to be introduced therein through the inlet port 1431. On the other hand, the preceding compression chamber V1 forms a compression chamber, allowing a refrigerant filled therein to be compressed. As the refrigerant accommodated in the preceding compression chamber V1 has not yet reached a discharge pressure, a gas force or vane reaction force is not generated in the preceding compression chamber V1, or a level (or amount) that is negligible even if it is generated.

Next, in (d) of FIG. 3, the rotational shaft 130 is rotated approximately 180°. In this state, the hinge groove 1441*a* of the roller 1441 is furthest apart from the inner circumferential surface of the cylinder 143, and the vane 1445 is drawn out from the vane slot 1432 to a maximum. In the preceding compression chamber V1, a compression stroke has progressed considerably, and thus, the refrigerant accommodated therein is almost close to a discharge pressure.

Next, in (e) of FIG. 3, the rotational shaft 130 is rotated about 240°. In this state, the hinge groove 1441*a* of the roller 144 moves back to the inner circumferential surface of the cylinder 143, and the vane 1445 is partially introduced into the vane slot 1432. At this time, the refrigerant accommodated in the preceding compression chamber V1 has reached the discharge pressure so that a discharge stoke has been started, or is about to start. Accordingly, in this state, a pressure difference between the preceding compression chamber V1 and the compression chamber V2 reaches the maximum or almost the maximum, and thus, the allowable clearance between the cylinder 143 and the roller 1441 becomes almost a minimum, as described above.

Next, in (f) of FIG. 3, the rotational shaft 130 is rotated about 300°. At this time, discharge of the refrigerant in the preceding compression chamber V1 is almost complete. The hinge groove 1441*a* of the roller 1441 is almost in contact with the inner circumferential surface of the cylinder 143, and the vane 1445 is almost introduced into the vane slot 1432. In this state, the pressure difference between the preceding compression chamber V1 and the following compression chamber V2 is reduced, and thus, the allowable clearance between the cylinder 143 and the roller 1441 is gradually increased.

As described above, in the rotary compressor, the outer circumferential surface of the eccentric portion and the inner circumferential surface of the roller are separated from each other by a tiny or minute clearance, so that oil may flow into the clearance between the eccentric portion and the roller to thereby form an oil film. This allows friction loss between the eccentric portion and the roller to be suppressed.

However, the clearance between the outer circumferential surface of the eccentric portion and the inner circumferential surface of the roller is usually controlled in μm units. This may have a limitation in suppressing friction loss between the eccentric portion and the roller as oil flowing into the clearance between the eccentric portion and the roller cannot be widely spread or dispersed between the eccentric portion and the roller.

In order to prevent this, in some embodiments, an oil supply groove may be provided between the outer circumferential surface of the eccentric portion and the inner circumferential surface of the roller to be elongated in the circumferential direction. Accordingly, a large amount of oil may flow between the outer circumferential surface of the eccentric portion and the inner circumferential surface of the roller, allowing the oil to be widely spread while being held between the outer circumferential surface of the eccentric portion and the inner circumferential surface of the roller. As a result, a thick oil film may be formed between the eccentric portion and the roller to thereby reduce friction loss between the eccentric portion and the roller, and improve compressor efficiency. Hereinafter, an example in which an oil supply groove is formed on the outer circumferential surface of the eccentric portion will be described.

Figure 4:
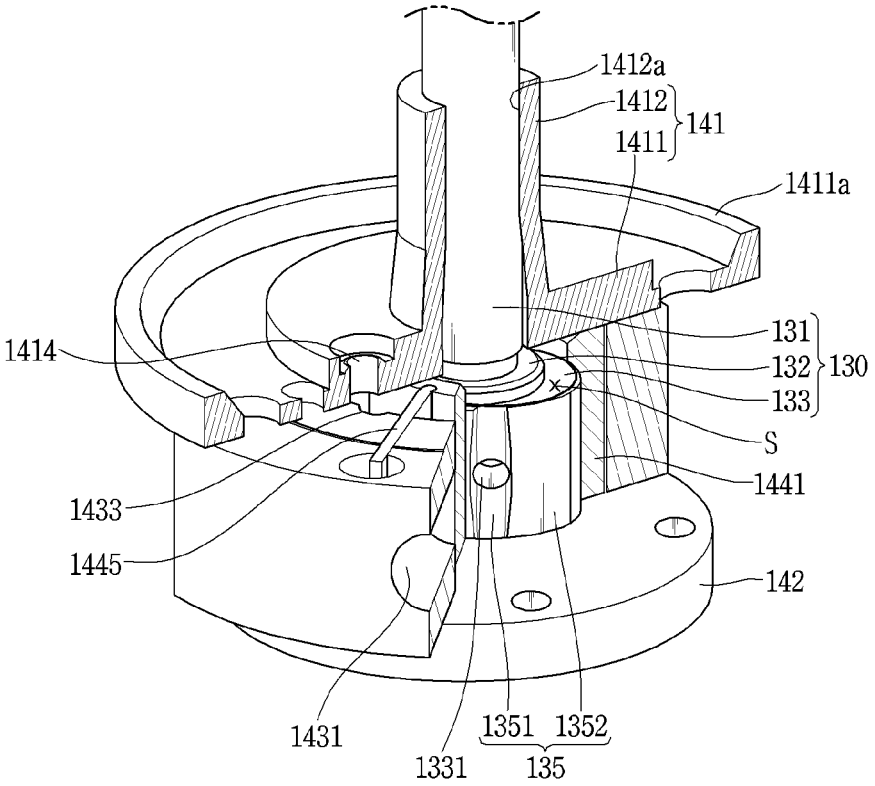
FIG. 4 is a cut perspective view of a compression unit in FIG. 1.
Figure 5:
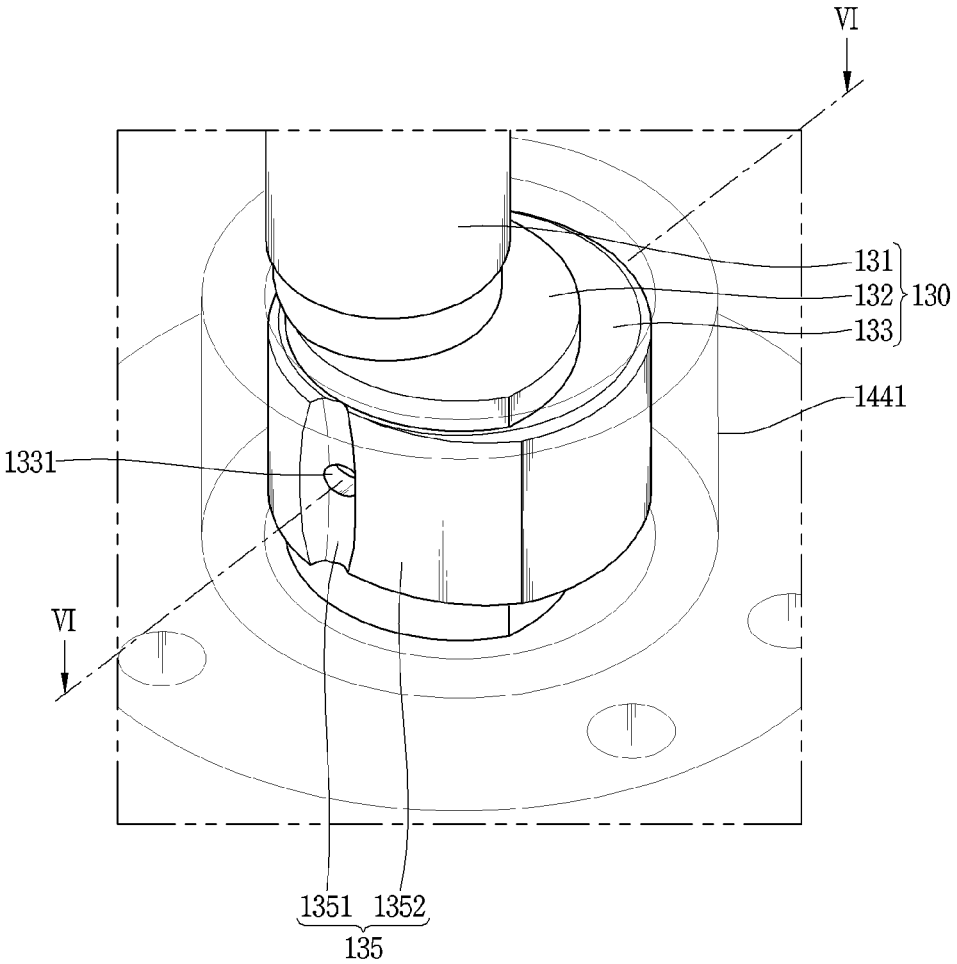
FIG. 5 is a perspective view illustrating a periphery of an eccentric portion of a rotational shaft in FIG. 4.
Figure 6:
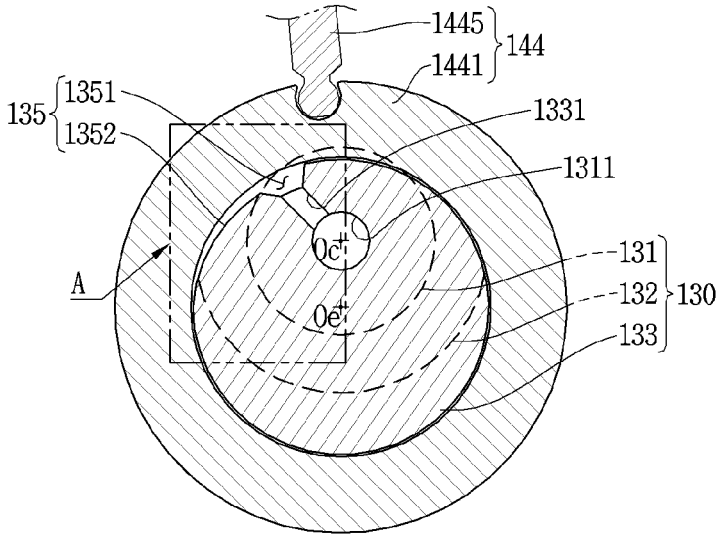
FIG. 6 is a cross-sectional view, taken along the line VI-VI of FIG. 5.
Figure 7:
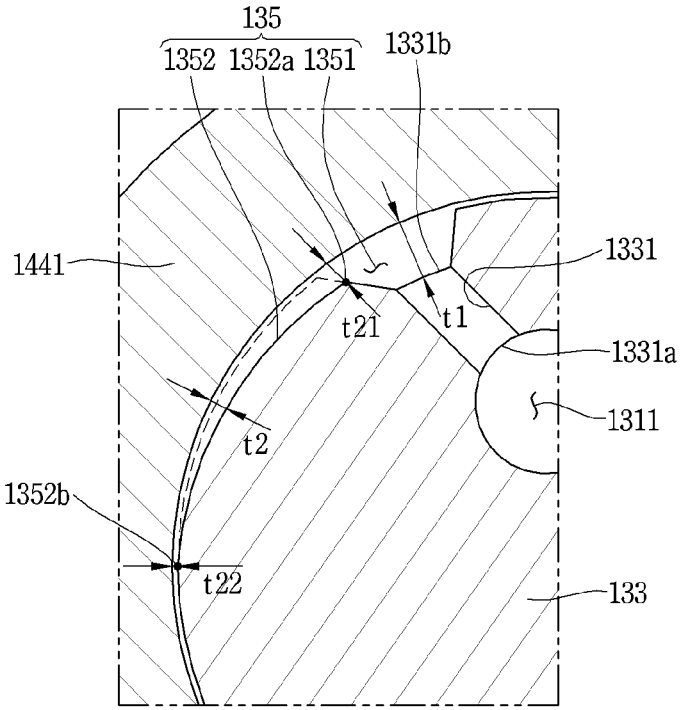
FIG. 7 is an enlarged cross-sectional view of area "A" of FIG. 6.

FIG. 4 is a cut perspective view of a compression unit in FIG. 1. FIG. 5 is a perspective view illustrating a periphery of an eccentric portion of a rotational shaft in FIG. 4. FIG. 6 is a cross-sectional view, taken along the line VI-VI of FIG. 5. FIG. 7 is an enlarged cross-sectional view of area "A" of FIG. 6.

Referring back to FIG. 1, in the rotational shaft 130 according to this embodiment, the bearing portion 132 is provided at a lower portion or part of the shaft portion 131 to be eccentric in the radial direction, and the eccentric portion 133 is disposed to be eccentric from an outer circumferential surface of the bearing portion 132 in a same direction as the bearing portion 132. As an outer diameter of the eccentric portion 133 is greater than an outer diameter of the bearing portion 132, the outer circumferential surface of the eccentric portion 133 is slidingly inserted into the inner circumferential surface of the roller 1441 in the circumferential direction.

In addition, as an axial height of the eccentric portion 133 is less (lower) than an axial height of the roller 1441, a step may be formed between the bearing portion 132 and the eccentric portion 133 in the axial direction, and a kind of oil supply space S may be formed at both axial ends of the eccentric portion 133. The bearing portion 132 may not be provided, and the eccentric portion 133 may be disposed to be eccentric from the outer circumferential surface of the shaft portion 131 in the radial direction. However, in this case, a height of the eccentric portion 133 should be increased, and accordingly, a total weight of the rotational shaft 130 may be increased. Therefore, an example in which the bearing portion 132 is disposed to be eccentric from the shaft portion 131, and an example in which the eccentric portion 133 is disposed to be eccentric from the bearing portion 132 will be described hereinafter.

Referring to FIGS. 1 and 4, the first oil supply hole 1311 may be formed through both axial ends of the shaft portion 131, and the second oil supply hole 1331 may be formed in the eccentric portion 133 in a manner of penetrating from an inner circumferential surface of the first oil supply hole 1311 to the outer circumferential surface of the eccentric portion 133. The first oil supply hole 1311 may be formed through the shaft portion 131 in the axial direction, or formed through the shaft potion 131 to be inclined with respect to the axial direction. In addition, the first oil supply hole 1311 may be formed through both ends of the shaft portion 131, or formed from a lower end of the shaft portion 131 to a predetermined height. In this embodiment, an example in which the first oil supply hole 1311 is formed through the shaft portion 131 in the axial direction will be described.

An oil feeder (not shown) may be provided at a lower end of the first oil supply hole 1311. The oil feeder may be implemented as a plate having a spiral or propeller shape, or configured as an oil pump, for example.

Referring to FIGS. 5 and 6, the second oil supply hole 1331 may be formed in the eccentric portion 133 in the radial direction. One or more of the second oil supply holes 1331 may be provided. When a plurality of second oil supply holes 1331 is provided, they may be arranged in the radial direction. In this embodiment, an example in which one second oil supply hole 1331 is provided will be described.

An inlet end 1331*a* (see FIG. 7) of the second oil supply hole 1331 may communicate with the inner circumferential surface of the first oil supply hole 1311, and an outlet end 1331*b* may be accommodated in a first oil supply groove (first oil supply groove portion) 1351 described hereinafter. Accordingly, the second oil supply hole 1331 may provide communication between the first oil supply hole 1311 and the first oil supply groove 1351.

In addition, when looking at the oil supply groove 135 as a whole, the second oil supply hole 1331 may be eccentric with respect to a center of the oil supply groove 135. For example, in the oil supply groove 135, a second oil supply groove (second oil supply groove portion) 1352 described hereinafter may extend from one end of the first oil supply groove 1351 in the circumferential direction. Accordingly, the second oil supply hole 1331 may be formed at a position eccentric with respect to the center of the oil supply groove 135 including the first oil supply groove 1351 and the second oil supply groove 1352. In other words, the second oil supply hole 1331 may be formed within a range of the oil supply groove 135 and located at a downstream side of the oil supply groove 135 with respect to a rotational direction of the rotational shaft 130.

The outlet end 1331*b* of the second oil supply hole 1331 may be formed at a minimum load point A (see FIG. 8) at which the eccentric portion (more precisely, a bearing surface between the eccentric portion and the roller) 133 receives a minimum surface pressure. Accordingly, of the outer circumferential surface of the eccentric portion 133, a point or portion at which the outlet end 1331*b* of the second oil supply hole 1331 is formed is the farthest away from the inner circumferential surface of the roller 1441 facing the outlet end 1331*b* of the second oil supply hole 1331, allowing oil to be smoothly discharged through the second oil supply hole 1331.

However, the outlet end 1331*b* of the second oil supply hole 1331 may not be necessarily formed at a position to which the minimum surface pressure is applied. For example, the outlet end 1331*b* of the second oil supply hole 1331 may be formed at a position other than a maximum load point B (see FIG. 9) at which the maximum surface pressure is applied.

Hereinafter, the oil supply groove will be described.

Referring to FIGS. 4 and 5, the oil supply groove 135 according to this embodiment may be provided at the outer circumferential surface of the eccentric portion 133. The oil supply groove 135 may include the first oil supply groove 1351 and the second oil supply groove 1352.

The first oil supply groove 1351 may accommodate the outlet end 1331*b* of the second oil supply hole 1331 therein. Accordingly, a circumferential length of the first oil supply groove 1351 may be substantially the same as an inner diameter of the second oil supply hole 1331 or greater than the second oil supply hole 1331.

A circumferential surface of the first oil supply groove 1351 may have a wedge cross-sectional shape in axial projection. However, the first oil supply groove 1351 may not be necessarily formed in the wedge cross-sectional shape. For example, the first oil supply groove 1351 may have a polygonal or arcuate cross-sectional shape in axial projection.

In addition, the first oil supply groove 1351 may be formed such that both axial ends thereof are open toward the main bearing 141 and the sub bearing 142, respectively. Accordingly, the second oil supply hole 1331 may communicate with the space S provided at both axial sides of the eccentric portion 133 without an interruption even when the outer circumferential surface of the eccentric portion 133 and the inner circumferential surface of the roller 1441 are close enough to be in contact with each other.

Oil flowing to the first oil supply groove 1351 through the second oil supply hole 1331 may quickly flow to both axial ends of the roller 1441 through the open both axial ends of the first oil supply groove 1351. Then, the oil may smoothly flow from the first oil supply hole 1311 to the second oil supply hole 1331 to thereby smoothly provide lubrication between the both axial ends of the roller 1441 and bearings 141 and 142 that respectively face the both axial ends of the roller 1441.

However, the both axial ends of the first oil supply groove 1351 may not necessarily be open toward the main bearing 141 and the sub bearing 142. Only one axial end of the first oil supply groove 1351 may be open, or both axial ends of the first oil supply groove 1351 may be blocked whereas both axial ends (or one axial end) of the second oil supply groove 1352, which will be described hereinafter, may be open toward the main bearing 141 and/or the sub-bearing 142.

In this case, as oil introduced into the first oil supply groove 1351 flows to the second oil supply groove 1352 without flowing directly to the both axial ends thereof, a large amount oil may be guided to the maximum load point B of the outer circumferential surface of the eccentric portion 133 at which the maximum surface pressure is applied. This will be described again hereinafter.

The first oil supply groove 1351 may be elongated in the axial direction, whereas the second oil supply groove 1352 may be elongated in the circumferential direction. Referring to FIGS. 4 and 5, the second oil supply groove 1352 according to this embodiment may extend from one end of the first oil supply groove 1351 in the circumferential direction. For example, the second oil supply groove 1352 may extend toward a rotational direction of the rotational shaft 130 with respect to the first oil supply groove 1351 or the second oil supply hole 1331.

Accordingly, the second oil supply groove 1352 may be eccentric in one direction along the circumferential direction with respect to the second oil supply hole 1331. Oil flowing to the first oil supply groove 1351 through the second oil supply hole 1331 may flow along the second oil supply groove 1352 in one direction of the circumferential direction.

The second oil supply hole 1331 may be located eccentric to one side from a perspective of the second oil supply groove 1352. This is suitable for suppressing a vortex of oil or oil supply resistance that may occur when the second oil supply hole 1331 is formed at a middle of the second oil supply groove 1352, namely, a center of the second oil supply groove 1352 in the circumferential direction.

In addition, the second oil supply hole 1331 may be eccentric with respect to the second oil supply groove 1352 and formed at a position adjacent to a first virtual line CL1 (see FIG. 8) that passes through the axial center Oc and a center Oe of the eccentric portion 132. As the second oil supply hole 1331 is formed in the first oil supply groove 1351 which is located adjacent to the axial center Oc, a length of the second oil supply hole 1331 may be reduced. This may facilitate fabrication or processing of the second oil supply hole 1331. Further, as the length of the second oil supply hole 1331 is reduced, flow resistance caused by oil viscosity may be reduced, allowing oil to be quickly discharged to the oil supply groove 135.

Like the first oil supply groove 1351, the second oil supply groove 1352 may have both axial ends open toward the main bearing 141 and the sub bearing 142, respectively. However, the both axial ends of the second oil supply groove 1352 may not necessarily be open toward the main bearing 141 and the sub bearing 142. For example, the second oil supply groove 1352 may be formed such that only one axial end is open or one of the both axial ends is entirely or partially open. This will be described hereinafter.

The second oil supply groove 1352 may be formed such that a volume per unit area varies along the circumferential direction. Referring to FIGS. 6 and 7, the second oil supply groove 1352 according to this embodiment may be formed such that the volume per unit area decreases with an increase in distance from the first oil supply groove 1351. That is, the second oil supply groove 1352 may have a first end 1352*a* that extends from the first oil supply groove 1351 and forms a boundary with the first oil supply groove 1351, and a second end 1352*b* that forms a boundary with the outer circumferential surface of the eccentric portion 133 to define another end in the circumferential direction with respect to the first end 1352*a*. The second oil supply groove 1352 may be formed such that the first end 1352*a* has a largest volume per unit area and the second end 1352*b* has a smallest volume per unit area.

For example, the second oil supply groove 1352 may be formed such that a depth t2 in the radial direction (or radial depth) varies along the circumferential direction. That is, the second oil supply groove 1352 may be formed such that the depth t2 gradually decreases from the first end 1352*a* to the second end 1352*b*. Accordingly, the depth t2 of the second oil supply groove 1352 is the greatest (deepest) in the first end 1352*a* and the lowest (shallowest) in the second end 1352*b*.

In other words, the second oil supply groove 1352 may be formed such that a depth t21 of the first end 1352*a* is less than a maximum depth (a depth in a central portion) t1 of the first oil supply groove 1351, and a depth t22 of the second end 1352*b* may be zero (0) as the second end 1352*b* is in contact with the outer circumferential surface of the eccentric portion 133. Accordingly, the second oil supply groove 1352 has the largest volume in the first end 1352*a*, and the volume decreases toward the second end 1352*b*. Of the bearing surface between the eccentric portion 133 and the roller 1441, the second oil supply groove 1352 may be provided at a position out of the maximum load point B at which the maximum surface pressure is applied but located as close as possible to the maximum load point B.

Figure 8:
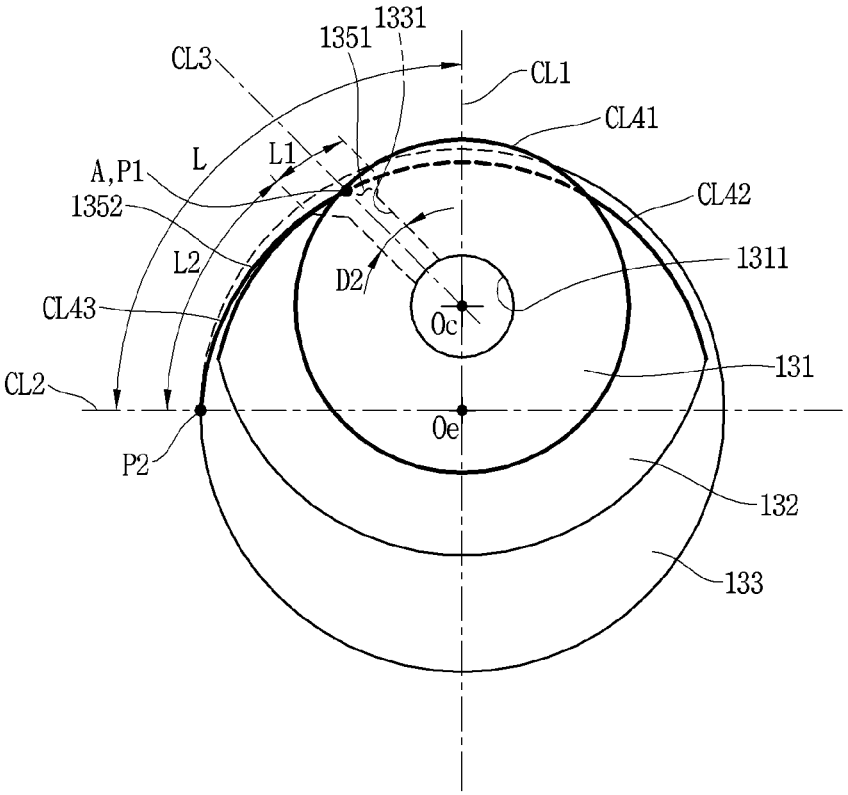
FIG. 8 is a schematic view illustrating a position of a second oil supply groove according to an embodiment.
Figure 9:
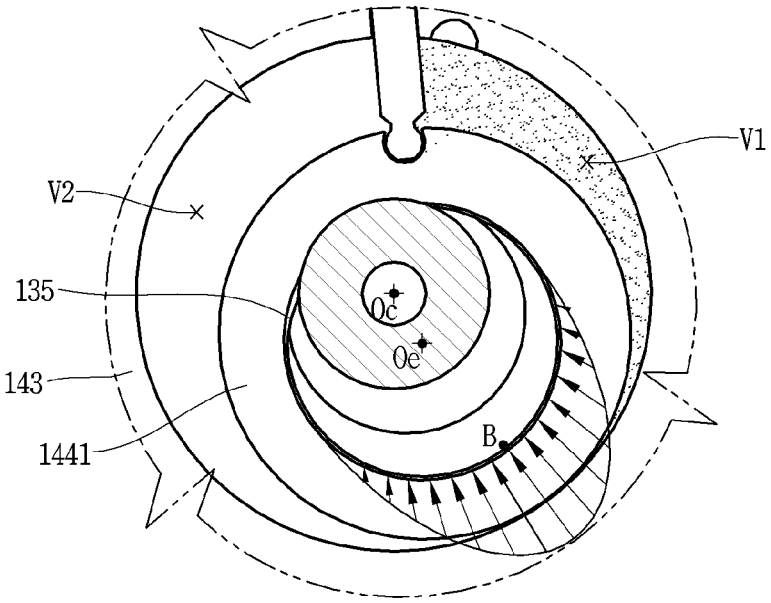
FIG. 9 is a schematic view illustrating surface pressure distribution between an eccentric portion and a roller according to an embodiment.

FIG. 8 is a schematic view illustrating a position of a second oil supply groove according to an embodiment. FIG. 9 is a schematic view illustrating surface pressure distribution between an eccentric portion and a roller according to an embodiment.

Referring to FIG. 8, the second oil supply groove 1352 according to this embodiment may be located at one side with respect to a first virtual line CL1 that passes through the axial center Oc of the rotational shaft 130 and the center Oe of the eccentric portion 133. That is, when a line that is orthogonal to the first virtual line CL1 and passes through the center Oe of the eccentric portion 133 is referred to as a second virtual line CL2, at least a portion of the second oil supply groove 1352 may be located at a side opposite to the eccentric side of the eccentric portion 133. That is, when divided into four planes by the first virtual line CL1 and the second virtual line CL2, these four planes are referred to as first to fourth planes in a counterclockwise direction from the right side of the axial center Oc. Then, at least a portion of the second oil supply groove 1351, together with the first oil supply groove 1351, may be included in the second plane.

However, considering surface pressure applied to the bearing surface between the eccentric portion 133 and the roller 1441, the entire second oil supply groove 1352 according to this embodiment may be included in the second plane. That is, as shown in FIG. 8, the oil supply groove 135 according to this embodiment may be provided between a first point P1 at which a first curve CL41 that defines the outer circumferential surface of the shaft portion 131 in axial projection and a second curve CL42 that defines the bearing portion 132 in axial projection intersect and a second point P2 at which a third curve CL43 which is orthogonal to the first virtual line CL1 and defines the outer circumferential surface of the eccentric portion 133 and the second curve CL42 meet.

Referring to FIGS. 8 and 9, a surface pressure applied to the bearing surface between the eccentric portion 133 and the roller 1441 is greatest when the discharge valve 146 is open, namely, at a discharge start angle, causing the maximum load point B. This is because the pressure in a compression chamber V in which the outlet port 1414 is included is the greatest (highest) when a rotational angle of the rotational shaft (more precisely, the eccentric portion) 130 reaches the discharge start angle. This surface pressure gradually decreases before and after a discharge start point, and is hardly generated thereafter with respect to the second virtual line CL2.

Accordingly, in order to allow a sufficient amount of oil to be supplied in the oil supply groove 135, the second oil supply groove 1352 may be provided at a section in which surface pressure is hardly generated, for example, between the second virtual line CL2 and a third virtual line CL3 which is a longitudinal center line of the second oil supply hole 1331, or may be formed to be approximately 90 to 110% of an arc length between the second virtual line CL2 and the third virtual line CL3. In addition, a circumferential length L2 of the second oil supply groove 1352 may be greater (longer) than a circumferential length L1 of the first oil supply groove 1351. That is, the circumferential length L1 of the first oil supply groove 1351 may be slightly greater than or equal to an inner diameter D2 of the second oil supply hole 1331, and the circumferential length L2 of the second oil supply groove 1352 may be much greater than the inner diameter D2 of the second oil supply hole 1331 (or the circumferential length of the first oil supply groove).

For example, a total circumferential length L of the oil supply groove 135 including the first oil supply groove 1351 and the second oil supply groove 1352 may be 20% or more of a total circumferential length of the eccentric portion 133. A large amount of oil may be introduced and stored in the first oil supply groove 1351 and the second oil supply groove 1352 that defines a kind of oil storage space between the outer circumferential surface of the eccentric portion 133 and the inner circumferential surface of the roller 1441 to thereby smoothly provide lubrication between the eccentric portion 133 and the roller 1441. Accordingly, friction loss between the eccentric portion 133 and the roller 1441 may be reduced, allowing efficiency of the compressor to be increased.

Figure 10:
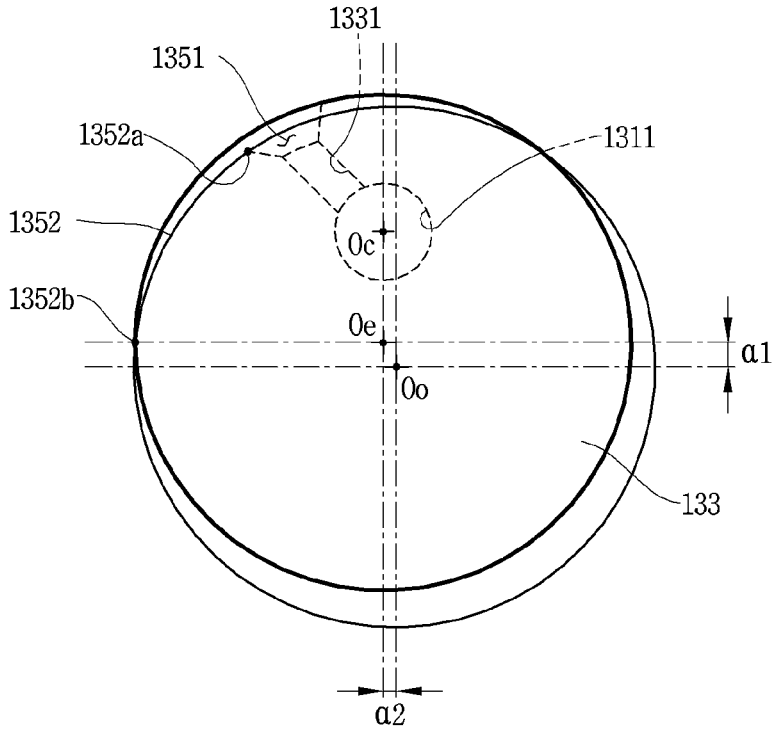
FIG. 10 is a schematic view illustrating an example shape of a circumferential surface of a second oil supply groove by comparing it with an outer circumferential surface of an eccentric portion.

A circumferential surface of the second oil supply groove 1352 according to this embodiment may be curved or linear. An example in which the circumferential surface of the second oil supply groove 1352 is curved will be described first, and an example in which in the circumferential surface of the second oil supply groove 1352 is linear will be described hereinafter. FIG. 10 is a schematic view illustrating an example shape of a circumferential surface of a second oil supply groove by comparing it with an outer circumferential surface of an eccentric portion.

The second oil supply groove 1352 according to this embodiment may define a portion of the outer circumferential surface of the eccentric portion 133 and be curved to have a circumferential surface with an arcuate shape. Referring to FIG. 10, the second oil supply groove 1352 may be eccentric with respect to the eccentric portion 133. In other words, a center Oo of a circle formed by extending the circumferential surface of the second oil supply groove 1352 (hereinafter, "center of the oil supply groove") may be eccentric with respect to a center Oe of a circle connecting the outer circumferential surface of the eccentric portion 133 (hereinafter, "center of the eccentric portion") in two directions on a plane by predetermined intervals (or distances) $\alpha$1 and $\alpha$2, respectively.

That is, the second oil supply groove 1352 may be eccentric to a side at which the center Oo of the second oil supply groove 1352 is eccentric with respect to the center Oe of the eccentric portion 133, namely, an opposite side of the axial center Oc with respect to the second virtual line CL2. Accordingly, the second oil supply groove 1352 may have the circumferential surface with the arcuate shape and have a depth that gradually decreases from the first end 1352*a* to the second end 1352*b*.

That is, when the second oil supply groove 1352 is open in the axial direction as in this embodiment, oil introduced into the second oil supply groove 1352 through the first oil supply groove 1351 may flow to the axial direction by its own weight. Even when the second oil supply groove 1352 is formed to extend lengthwise in the circumferential direction, oil cannot remain between the eccentric portion 133 and the roller 1441, and thus, oil may leak into upper and lower empty spaces of the eccentric portion 133 from the second oil supply groove 1352. Thus, a wide and thick oil film may not be formed between the outer circumferential surface of the eccentric portion 133 and the inner circumferential surface of the roller 1441. However, when the depth of the second oil supply groove 1352 is configured to decrease with an increase in distance from the first oil supply groove 1351, as in this embodiment, a large amount of oil remains between the eccentric portion 133 and the roller 1441, allowing friction loss between the eccentric portion 133 and the roller 1441 to be reduced.

Figure 11:
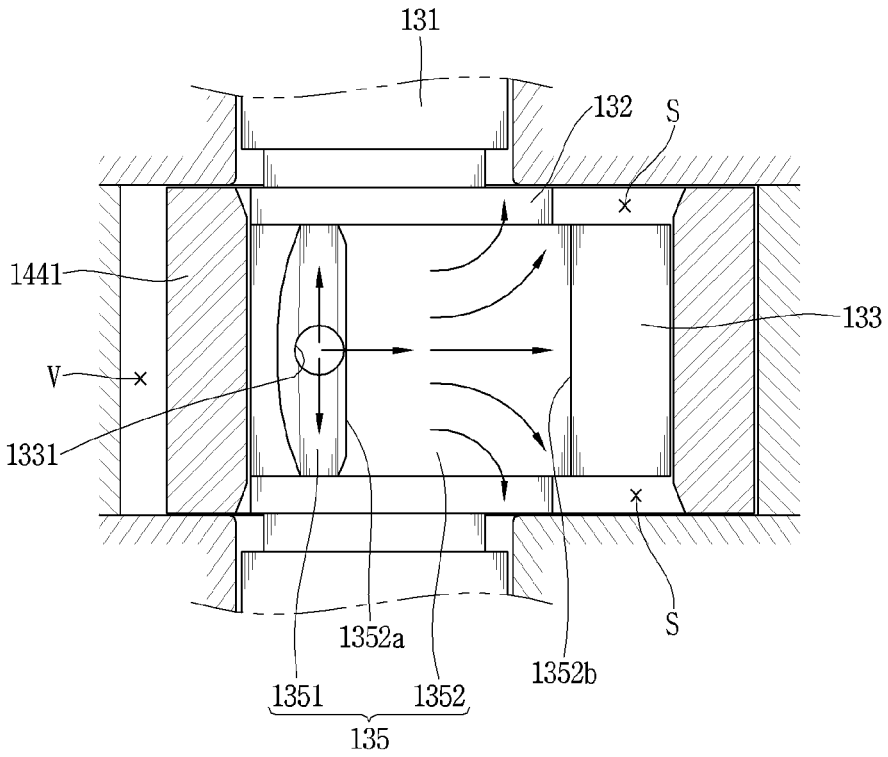
FIG. 11 is a schematic view illustrating a flow of oil in an oil supply groove of an eccentric portion according to an embodiment.

FIG. 11 is a schematic view illustrating an oil flow in an oil supply groove of an eccentric portion according to an embodiment. Referring to FIG. 11, oil flows to the first oil supply groove 1351 through the second oil supply hole 1331, and this oil flows toward the second oil supply groove 1352 where pressure is relatively low. The oil flowing to the second oil supply groove 1352 moves at a fast speed along the circumferential direction toward the second end 1352*b* that has a relatively low pressure in the second oil supply groove 1352, allowing the oil to flow to the both axial ends of the second oil supply groove 1352 from the second end 1352*b*.

A large amount of oil remains evenly in the second oil supply groove 1352, allowing a wide and thick oil film to be formed between the outer circumferential surface of the eccentric portion 133 and the inner circumferential surface of the roller 1441. Even when the eccentric portion 133 rotates with respect to the roller 1441, oil remaining in the second oil supply groove 1352 of the eccentric portion 133 may lubricate the inner circumferential surface of the roller 1441 to thereby reduce friction loss between the eccentric portion 133 and the roller 1441.

This can be particularly useful when the compressor is operated at a low speed. That is, when the compressor is operated at a low speed, an amount of oil flowing to the first oil supply groove 1351 through the second oil supply hole 1331 decreases. In this case, when the second oil supply groove 1352 has a constant or same depth along the circumferential direction, oil introduced into the first end 1352*a* of the second oil supply groove 1352 may not flow to the second end 1352*b* and escape on its way to the second end 1352. As a result, oil may not be stored in the entire second oil supply groove 1352.

However, when the second oil supply groove 1352 has the depth t2 that decreases along the circumferential direction as in this embodiment, oil may remain evenly throughout the second oil supply groove 1352 while flowing into the second oil supply groove 1352, due to a pressure difference, even during a low-speed operation of the compressor. This may result in providing effective lubrication between the eccentric portion 133 and the roller 1441 even when the compressor is operated at the low speed.

Figure 12:
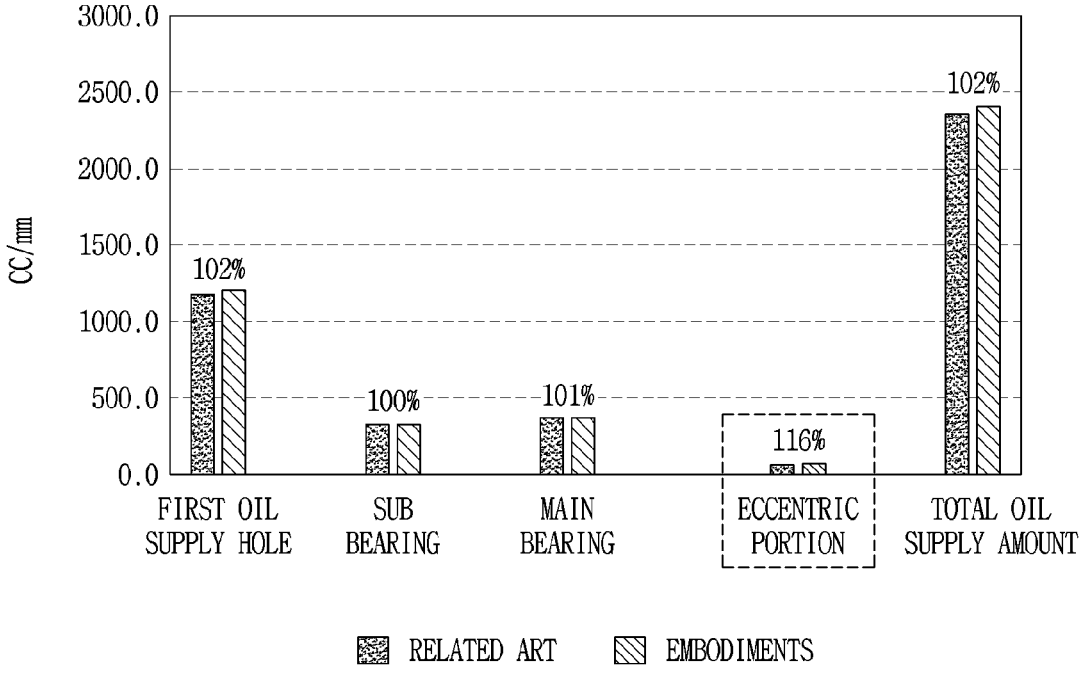
FIG. 12 is a graph showing results of an amount of oil supply to each portion of a rotational shaft according to an embodiment and according to the related art.

FIG. 12 is a graph showing results of an amount of oil supply to each portion of a rotational shaft according to an embodiment and according to the related art. This is a graph comparing the amount of oil supply during constant speed operation (50 to 60 Hz) in a hinge vane type rotary compressor.

Referring to FIG. 12, an amount of oil supply in an inlet (or entry) of the first oil supply hole 1311, an amount of oil supply in the sub bearing 142, and an amount of oil supply in the main bearing 141 are improved by about 1 to 2% or the same compared to those of the related art. However, it can be seen that an amount of oil supply in the eccentric portion 133 is 16% higher than that of the related art.

Accordingly, even if the same amount of oil is suctioned up by the oil feeder, the amount of oil remaining between the eccentric portion 133 and the roller 1441 actually increases. As a result, lubrication properties between the eccentric portion 133 and the roller 1441 may be improved to thereby reduce friction loss.

This may be particularly effective in the hinge vane type rotary compressor. As the roller 1441 is constrained to the cylinder by the hinge vane in the hinge vane type rotary compressor, friction loss between the eccentric portion 133 and the roller 1451 may be increased compared to a rolling roller type rotary compressor.

However, in embodiments disclosed herein, as the oil supply groove 135 extends lengthwise in the circumferential direction, the volume is decreased along the circumferential direction, allowing the amount of oil supply between the eccentric portion 133 and the roller 1441 to be increased. Accordingly, friction loss between the roller 1441 and the eccentric portion 133 may be suppressed even in a state in which the roller 1441 is constrained to the cylinder 143. This may result in suppressing a decrease in efficiency of the compressor caused by the friction loss between the eccentric portion 133 and the roller 1441.

Hereinafter, description will be given of another example of a shape of the second oil supply groove 1352. That is, in the example described above, the second oil supply groove 1352 has an arcuate shape, but in some cases, the second oil supply groove 1352 may have a linear shape.

Figure 13:
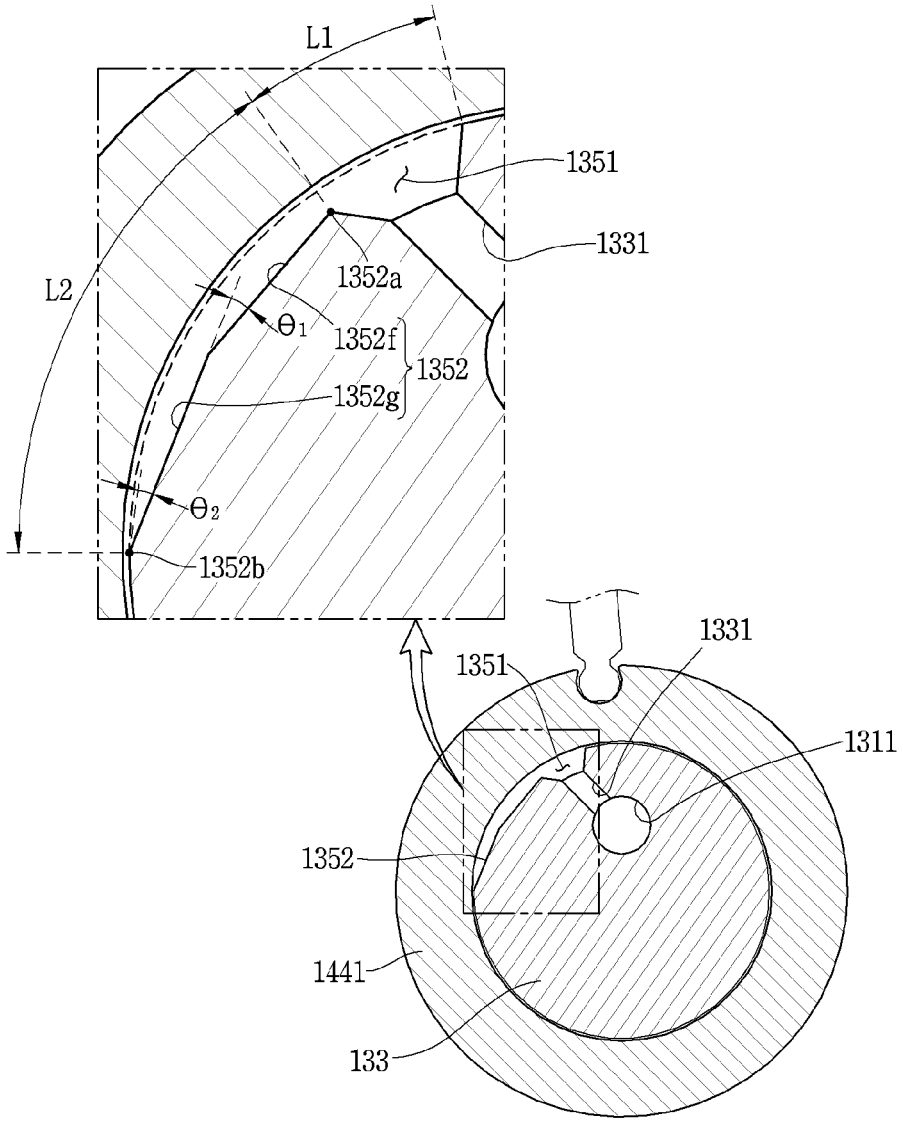
FIG. 13 is a schematic view illustrating a second oil supply groove according to another embodiment.

FIG. 13 is a schematic view illustrating a second oil supply groove according to another embodiment. Referring to FIG. 13, the second oil supply groove 1352 may have a linear shape. That is, the first end 1352*a* of the second oil supply groove 1352 may extend from one end of the first oil supply groove 1351, and the second end 1352*b* of the second oil supply groove 1352 may extend in the circumferential direction so as to be connected to the outer circumferential surface of the eccentric portion 133. Accordingly, the second oil supply groove 1352 may have a circumferential length L1 greater than that of the second oil supply groove 1352.

The second oil supply groove 1352 may be formed as one linear surface. In this case, the second oil supply groove 1352 may be formed in a D-cut shape to thereby facilitate processing. However, if a circumferential length L2 of the second oil supply groove 1352 is the same as of the second oil supply groove 1352 having the arcuate shape of the example described above, a volume change rate of the second oil supply groove 1352 increases. This may lead to an increase in depth of the second oil supply groove 1352, and an amount of oil storage may be reduced accordingly.

In order to prevent this, the second oil supply groove 1352 according to this embodiment may be formed such that a plurality of linear surfaces is continuous and surface angles are different as shown in FIG. 13. For example, when the second oil supply groove 1352 is formed as two linear surfaces, a surface angle of a linear surface located farther away from the first oil supply groove 1351 may be smaller than a surface angle of a linear surface located adjacent to the first oil supply groove 1351.

That is, a side that is connected to the first oil supply groove 1351 may be referred to as a first linear surface 1352*f*, and a side that connects the first linear surface 1352*f* and the outer circumferential surface of the eccentric portion 133 may be referred to as a second linear surface 1352*g*. In addition, an angle of the first linear surface 1352*f* with respect to the second linear surface 1352*g* may be defined as a first surface angle θ1, and an angle formed by the second linear surface 1352*g* and a tangent line at an end 1352*b* of the second linear surface 1352*g* may be defined as a second surface angle θ2.

In this case, the first surface angle θ1 may be greater than the second surface angle θ2. That is, a length of the first linear surface 1352*f* may be less than a length of the second linear surface 1352*g*. Accordingly, the second oil supply groove 1352 may have the linear shape and the depth t2 of the second oil supply groove 1352 may not be excessively increased, allowing the amount of oil storage to be secured or reserved in the second oil supply groove 1352. In FIG. 13, the second oil supply groove includes two linear surfaces; however, embodiments are not limited thereto, and the second oil groove may have more than two linear surfaces. As the number of linear surfaces increases, the volume change rate of the second oil supply groove 1352 is reduced, which is more advantages to have more amount of oil storage.

Figure 14:
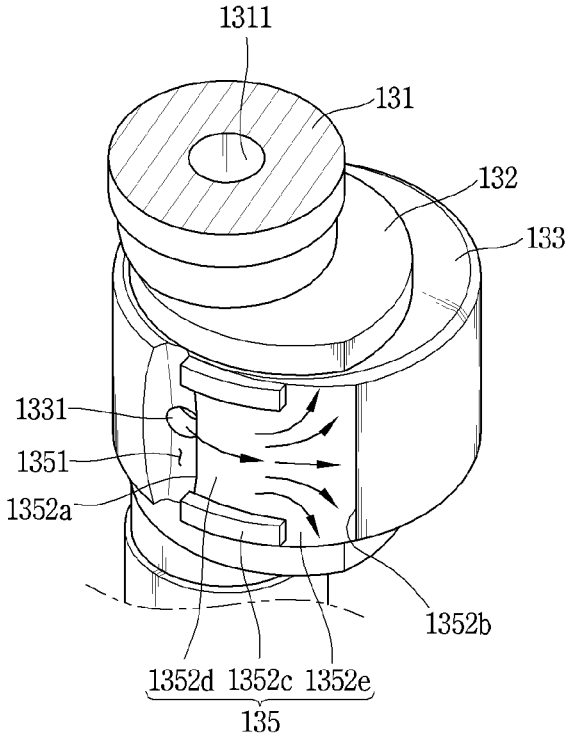
FIG. 14 is a perspective view illustrating an oil supply groove according to an embodiment.

Hereinafter, description will be given of another example of an oil supply groove. That is, in the examples described above, the both axial ends of the second oil supply groove are entirely open. However, in some embodiments, the both axial ends of the second oil supply groove may be partially closed. FIG. 14 is a perspective view illustrating an oil supply groove according to another embodiment.

Referring to FIG. 14, the second oil supply groove 1352 according to this embodiment may include sealing surface portions 1352*c*, an extended groove portion 1352*d*, and an open groove portion 1352*e*. Accordingly, the second oil supply groove 1352 may have a substantially T-shape in front projection.

The sealing surface portion 1352*c* may extend from the first end 1352*a* toward the second end 1352*b* of the second oil supply groove 1352 by a predetermined length in the circumferential direction. However, a circumferential end of the sealing surface portion 1352*c* may be formed up to a middle part or portion of the second oil supply groove 1352 by the open groove portion 1352*e* described hereinafter instead of extending to the second end 1352*b*.

In addition, an axial length of the sealing surface portion 1352*c* may be formed as small (thin) as possible. Owing to the sealing surface portion 1352*c*, a decrease in volume of the second oil supply groove 1352 may be minimized and an increase in friction loss may be suppressed.

The extended groove portion 1352*d* may extend in the circumferential direction by penetrating between the sealing surface portions 1352*c* located at both sides of the axial direction. The extended groove portion 1352*d* may extend from the first end 1352*a* to the second end 1352*b* of the second oil supply groove 1352.

In addition, the extended groove portion 1352*d* may have a same width in the circumferential direction, or may have a variable width along the circumferential direction. This may be determined by the sealing surface portion 1352*c*.

The open groove portion 1352*e* may extend from an end portion of the extended groove portion 1352*d* at the second end 1352*b* side toward both axial ends thereof. That is, the open groove portion 1352*e* may axially penetrate through the sealing surface portions 1352*c* located at both sides of the extended groove portion 1352*d*.

When the second oil supply groove 1352 is formed in the T-shape, it is possible to suppress oil introduced into the second oil supply groove 1352 from leaking in the axial direction due to clogging in the sealing surface portions 1352*c* provided at the both axial ends of the second oil supply groove 1352. Accordingly, oil may be stably guided to the second end 1352*b* of the second oil supply groove 1352 along the extended groove portion 1352*d*, and be then discharged to spaces provided at both axial sides of the eccentric portion 133 through the open groove portion 1352*e*. This may allow a large amount of oil to be stored in the second oil supply groove 1352, and thus, friction loss between the eccentric portion 133 and the roller 1441 may be more effectively reduced.

In a case in which the sealing surface portions 1352*c* are formed at both axial sides of the second oil supply groove 1352 as in this embodiment, the extended groove portion 1352*d* provided between the sealing surface portions 1352*c* and defines the actual second oil supply groove 1352 may be formed as a linear surface. Even when the extended groove portion 1352*d* has the linear shape, the both axial sides of the extended groove portion 1352*d* are respectively sealed by the sealing surfaces 1352*c*, allowing the extended groove portion 1352*d* to be increased in depth. This may result in an increase in amount of oil stored. Further, the extended groove portion 1352*d* may be formed as one linear surface, allowing workability or processability to be increased.

However, the extended groove portion 1352*d* may be curved having a circumferential surface with an arcuate shape.

Figure 15:
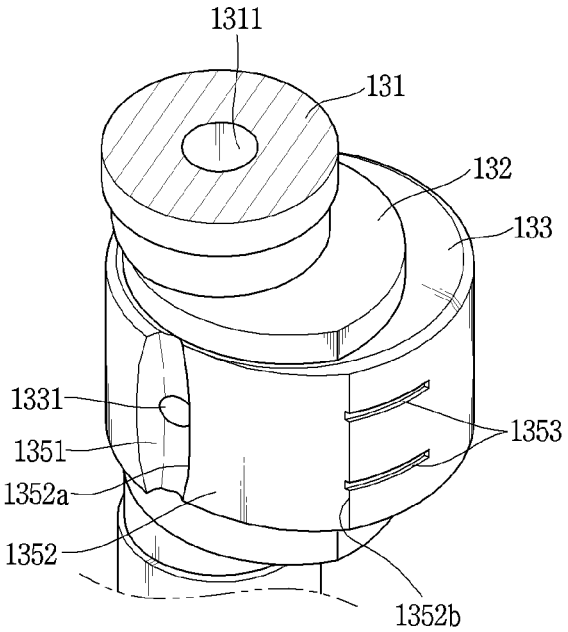
FIG. 15 is a perspective view illustrating an oil supply groove according to another embodiment.

Hereinafter, description will be given of another example of an oil supply groove. That is, in the examples describe above, the oil supply groove is configured as the first oil supply groove and the second oil supply groove, but in some cases, the oil supply groove may further include a third oil supply groove in addition to the first and second oil supply grooves. FIG. 15 is a perspective view illustrating an oil supply groove according to another embodiment.

Referring to FIG. 15, the oil supply groove 135 according to this embodiment may include the first oil supply groove 1351, second oil supply groove 1352, and a third oil supply groove 1353. As the first oil supply groove 1351 and the second oil supply groove 1352 are the same as those of the examples described above, a description thereof will be replaced with the description of the examples described above.

The third oil supply groove 1353 may extend from the second end 1352*b* of the second oil supply groove 1352 along the circumferential direction. An area of the third oil supply groove 1353 may be smaller than an area of the second oil supply groove 1352, and at least one or more of the third oil supply grooves 1353 may be spaced apart by a predetermined interval or distance along the axial direction. Accordingly, a kind of sealing surface may be formed between the third oil supply grooves 1351.

In addition, the third oil supply groove 1353 may extend to a part or portion that excludes the maximum load point as described above. In some embodiments, the third oil supply groove 1353 may extend up to the maximum load point. In this case, as the sealing surface is provided between the third oil supply grooves 1353, a decrease in surface pressure at the maximum load point B may be minimized. Thus, in order to secure the surface pressure, a total area of the third oil supply grooves 1353 on the same axial line may be less than a total area of the sealing surface.

When the third oil supply groove 1353 extends from the second oil supply groove 1352, a volume of the entire oil supply groove 135 increases. This may allow the amount of oil storage to be increased and oil to be guided to or near the maximum load point B. As a result, friction loss between the eccentric portion 133 and the roller 1441 may be further reduced.

Figure 16:
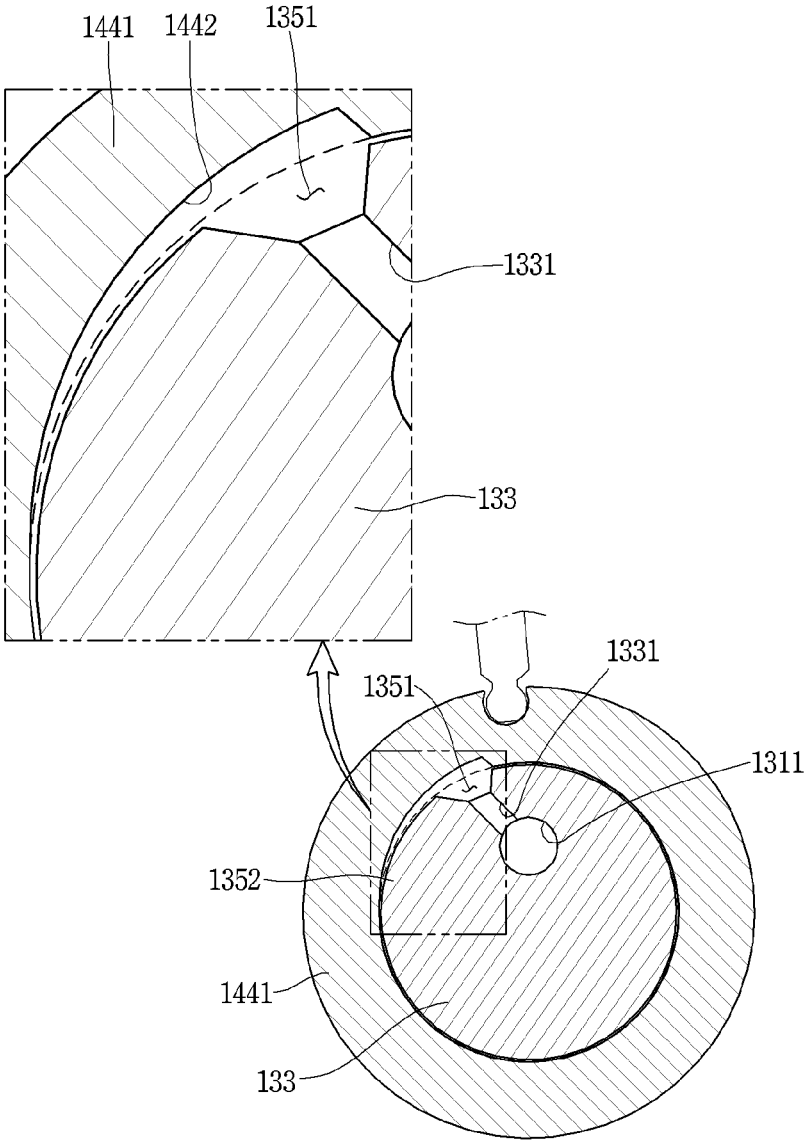
FIG. 16 is a schematic view illustrating an example in which a portion of an oil supply groove according to an embodiment is formed on an inner circumferential surface of a roller.

In the examples described above, the second oil supply groove is formed on the outer circumferential surface of the eccentric portion, but in some cases, the second oil supply groove may be formed on the inner circumferential surface of the roller. FIG. 16 is a schematic view illustrating an example in which a portion of an oil supply groove according to an embodiment is formed on an inner circumferential surface of a roller.

Referring to FIG. 16, the oil supply groove according to this embodiment may include first oil supply groove 1351 and a second oil supply groove 1442. The first oil supply groove 1351 may be recessed from the outer circumferential surface of the eccentric portion 133 by a predetermined depth, as in the examples described above. A description thereof will be replaced with the descriptions of the examples described above.

The second oil supply groove 1442 may be formed on the inner circumferential surface of the roller 1441 that corresponds to the outer circumferential surface of the eccentric portion 133. A basic configuration of the second oil supply groove 1442 may be substantially the same as the second oil supply groove 1352 of the examples described above. A description thereof will be replaced with the descriptions of the examples described above.

When a high-pressure refrigerant, such as R32, is used, a pressing force on the roller may be further increased, and thus, the oil supply groove according to embodiments may be usefully employed in a hinge vane type rotary compressor to which a high-pressure refrigerant is applied.

The oil supply groove according to embodiments disclosed herein may be equally applied to a rolling roller type rotary compressor. In particular, it may be usefully employed in a rolling roller type rotary compressor that selectively performs low-speed operation and high-speed operation according to a load.

Figure 17:
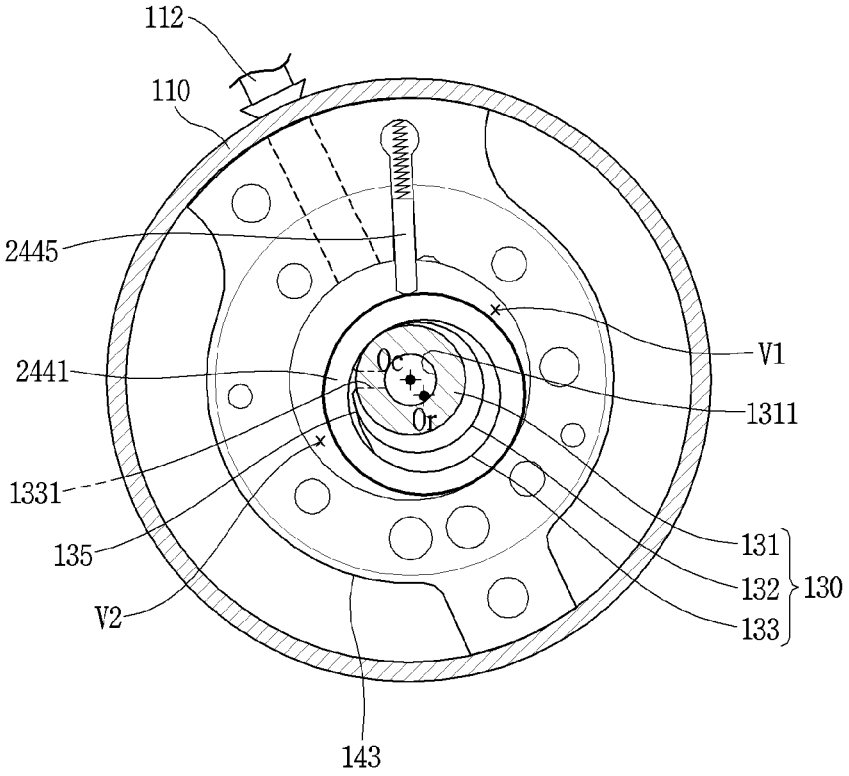
FIG. 17 is a cross-sectional view illustrating an example in which an oil supply groove according to an embodiment is employed in a rolling roller type rotary compressor.

FIG. 17 is a cross-sectional view illustrating an example in which an oil supply groove according to an embodiment is employed in a rolling roller type rotary compressor. Referring to FIG. 17, a vane 2445 may be slidingly coupled to cylinder 143, and a front-end surface of the vane 2445 may be in contact with an outer circumferential surface of roller 2441 in a detachable manner.

Even in this case, the second oil supply hole 1331 may be formed in the eccentric portion 133, and the oil supply groove 135 in communication with the second oil supply hole 1331 may be formed on the outer circumferential surface of the eccentric portion 133. The second oil supply hole 1331 may radially penetrate between the first oil supply hole 1311 and the outer circumferential surface of the eccentric portion 133 as in the examples described above, and the oil supply groove 135 may be formed along the outer circumferential surface of the eccentric portion 133 in the circumferential direction as in the examples described above.

For example, the second oil supply hole 1331 and the oil supply groove 135 may be formed in the same manner as in the hinge vane type rotary compressor described above. Thus, description thereof has been replaced with the description of the hinge vane type rotary compressor described above.

Embodiments disclosed herein provide a rotary compressor that may reduce friction loss between an outer circumferential surface of an eccentric portion and a roller. Embodiments disclosed herein further provide a rotary compressor that can reduce friction loss between an eccentric portion and a roller by increasing an amount of oil supply between the eccentric portion and the roller. Embodiments disclosed herein furthermore provide a rotary compressor that may allow oil supplied between an eccentric portion and a roller to be widely spread while forming a thick oil film.

Embodiments disclosed herein provide a rotary compressor that may allow oil introduced between an outer circumferential surface of an eccentric portion and an inner circumferential surface of a roller to quickly flow in a circumferential direction. Embodiments disclosed herein also provide a rotary compressor that can reduce a friction area between an eccentric portion and a roller and suppress an increase in surface pressure between the eccentric portion and the roller.

Additionally, embodiments disclosed herein provide a rotary compressor that may form an oil supply groove on an outer circumferential surface of an eccentric portion or an inner circumferential surface of a roller in an easier manner. Embodiments disclosed herein provide a rotary compressor that may smoothly provide lubrication between an eccentric portion and a roller and enhance motor efficiency by reducing weight of the eccentric portion or the roller.

Embodiments disclosed herein provide a rotary compressor in which a vane is hinged to a roller, the rotary compressor may include a groove that extends lengthwise in a circumferential direction and provided between the roller and an eccentric portion which is slidingly coupled to an inner circumferential surface of the roller. Accordingly, an amount of oil supplied between the roller and the eccentric portion may be increased to thereby reduce friction loss between the roller and the eccentric portion.

A depth of the groove may vary along the circumferential direction, and a hole may communicate with a deepest portion or point of the groove so as to allow oil to be supplied to the groove. Accordingly, oil introduced between the roller and the eccentric portion may quickly flow along the groove, allowing the oil to be widely spread between the roller and the eccentric portion.

The groove may be formed such that a volume decreases with an increase in distance from the portion in communication with the hole. For example, a depth of the groove may decrease with an increase in distance from the hole. This may generate a pressure difference in the groove, allowing oil to flow quickly.

The groove may be formed on the inner circumferential surface of the roller. In this case, a hole that supplies oil to the groove may be formed in the eccentric portion. This may result in reducing a weight of the roller to thereby increase motor efficiency.

A central angle of the groove may be less than 360 degrees and formed at a position out of a maximum load point of the eccentric portion. This may result in improving a lubrication effect and suppressing an increase in surface pressure.

The groove may be disposed to be eccentric with respect to the hole. This may allow oil to quickly flow along a rotational shaft that rotates in one direction.

Embodiments disclosed herein also provide a rotary compressor that may include a plurality of bearing plates; a cylinder provided between the plurality of bearing plates to form a compression space; a rotational shaft including a shaft portion that penetrates through the plurality of bearing plates, an eccentric portion that is accommodated in the compression space of the cylinder, a first oil supply hole formed in the shaft potion, and a second oil supply hole that penetrates from the first oil supply hole to an outer circumferential surface of the eccentric portion; a roller slidingly coupled to the eccentric portion of the rotational shaft so as to be moved along an inner circumferential surface of the cylinder by the rotational shaft; and a vane slidingly coupled to the cylinder so as to divide the compression space into a plurality of compression chambers. At least one of the outer circumferential surface of the eccentric portion and an inner circumferential surface of the roller that faces the outer circumferential surface of the eccentric portion may be provided with an oil supply groove formed along a circumferential direction to communicate with the second oil supply hole, and the oil supply groove may be formed such that a depth of a portion thereof far away from the second oil supply hole is less than a depth of a portion thereof adjacent to the second oil supply hole. Accordingly, oil introduced between the roller and the eccentric portion may quickly flow along the circumferential direction to thereby effectively lubricate between the roller and the eccentric portion.

The second oil supply hole may be located at an eccentric position with respect to a circumferential center of the oil supply groove. This may allow oil to quickly flow along the rotational shaft that rotates in one direction.

A depth of the oil supply groove may decrease as a distance in the circumferential direction from the second oil supply hole increases. Accordingly, oil may be spread widely and quickly throughout the oil supply groove to thereby form a wide oil film.

The second oil supply hole may be located at a rear side with respect to a rotational direction of the rotational shaft. Accordingly, a relatively low pressure may be generated as a distance from the second oil supply hole increases, allowing oil introduced into the second oil supply hole to quickly flow to an end of the oil supply groove.

The oil supply groove may include a first oil supply groove in which an end portion of the second oil supply hole may be accommodated, and a second oil supply groove that extends from one end of the first oil supply groove in a rotational direction of the rotational shaft. The second oil supply groove may be eccentric to one direction along the circumferential direction with respect to the second oil supply hole.

A circumferential length of the second oil supply groove may be greater than a circumferential length of the first oil supply groove. Accordingly, an area forming a wide and thick oil film may be increased. As a result, friction loss between the eccentric portion and the roller may be further reduced.

A maximum depth of the second oil supply groove may be less than a maximum depth of the first oil supply groove. This may allow oil introduced into the first oil supply groove to be widely spread while quickly flowing to the second oil supply groove.

A circumferential surface of the second oil supply groove may be curved in an arcuate shape, and a center of an arc of the second oil supply groove may be eccentric with respect to a center of a circle of the eccentric portion. Accordingly, a depth of the second oil supply groove may vary in the circumferential direction.

The center of the arc of the second oil supply groove may be located at an eccentric side of the eccentric portion rather than the center of the circle of the eccentric portion. Accordingly, the second oil supply groove may be formed at a side with a low (lower) surface pressure.

A circumferential surface of the second oil supply groove may be formed as at least one linear surface. This may allow the second oil supply groove to be formed in an easier manner.

The circumferential surface of the second oil supply groove may be formed as a plurality of linear surfaces, and the plurality of linear surfaces may be formed such that a linear surface in contact with the first oil supply groove has a largest surface angle and a linear surface located farthest from the first oil supply groove has a smallest surface angle. This may allow the second oil supply groove to be easily formed while achieving different depths.

The oil supply groove may include a first oil supply groove in which an end portion of the second oil supply hole may be accommodated, and a second oil supply groove that extends from one end of the first oil supply groove in a rotational direction of the rotational shaft. The second oil supply groove may be provided at a position out of a maximum load point formed between the outer circumferential surface of the eccentric portion and the inner circumferential surface of the roller. As the groove is formed on the outer circumferential surface of the eccentric portion that defines a bearing surface, a weight of the eccentric portion may be reduced and an increase in surface pressure may be suppressed.

At least a portion of the oil supply groove may be located at a side at which an axial center of the rotational shaft is located with respect to a second virtual line when a line that passes through the axial center of the rotational shaft and a center of the eccentric portion is referred to as a first virtual line, and a line that is orthogonal to the first virtual line and passes through the center of the eccentric portion is referred to as the second virtual line. Accordingly, the second oil supply groove may be formed at a side with a lower surface pressure to thereby increase reliability.

The oil supply groove may extend up to at least one of both axial sides of the eccentric portion and be open toward the plurality of bearing plates facing each other. This may allow oil to quickly flow to the second oil supply groove.

The oil supply groove may include a first oil supply groove in which an end portion of the second oil supply hole may be accommodated, and a second oil supply groove that extends from one end of the first oil supply groove in a rotational direction of the rotational shaft. The second oil supply groove may extend up to both axial sides of the eccentric portion and be open toward the plurality of bearing plates. Accordingly, oil may flow more quickly to the second oil supply groove.

The oil supply groove may include a first oil supply groove in which an end portion of the second oil supply hole may be accommodated, and a second oil supply groove that extends from one end of the first oil supply groove in a rotational direction of the rotational shaft. The first oil supply groove may extend up to at least one of both axial sides of the eccentric portion and be open toward the plurality of bearing plates facing each other. One of both axial sides of the second oil supply groove may be closed. Accordingly, oil may be quickly flow to an end of the second oil supply groove.

The second oil supply groove may include sealing surface portions that may be respectively provided at both axial sides of the eccentric portion, an extended groove portion that extends in the circumferential direction by penetrating between the sealing surface portions, and an open groove portion that extends from the extended groove portion and is open toward the plurality of bearing plates facing each other in an axial direction by penetrating through the sealing surface portions. Accordingly, the second oil supply groove may extend lengthwise in the circumferential direction, and oil may smoothly flow to an end of the second oil supply groove.

The oil supply groove may include a first oil supply groove in which an end portion of the second oil supply hole may be accommodated; a second oil supply groove that extends from one end of the first oil supply groove in a rotational direction of the rotational shaft; and a third oil supply groove that extends from the second oil supply groove in the circumferential direction. This may allow oil to flow farther along the outer circumferential surface of the eccentric portion.

A volume of the third oil supply groove may be less than a volume of the second oil supply groove. Thus, oil flowing into the second oil supply groove may smoothly flow to the third oil supply groove.

A bearing portion that extends from the shaft portion to be eccentric in a radial direction so as to be axially supported on the plurality of bearing plates may be further provided. When a point at which a first curve that defines an outer circumferential surface of the shaft portion and a second curve that defines the bearing portion intersect in axial projection is referred to as a first point, and a point at which a second virtual line that is orthogonal to a first virtual line passing through an axial center of the shaft portion and passes through a center of the eccentric portion meets a third curve that defines the outer circumferential surface of the eccentric portion is referred to as a second point, the first point and the second point may be spaced apart along the outer circumferential surface of the eccentric portion by a predetermined interval, and the oil supply groove may formed between the first point and the second point. Accordingly, the oil supply groove may be formed at a side with a lower surface pressure.

The second oil supply hole may be formed along a third virtual line that passes from the axial center of the shaft potion to the first point. This may allow the oil supply groove to be formed at a side with a lower surface pressure.

Embodiments disclosed herein further provide a rotary compressor that may include a plurality of bearing plates; a cylinder provided between the plurality of bearing plates to form a compression space; a rotational shaft including a shaft portion that penetrates through the plurality of bearing plates, an eccentric portion that is accommodated in the compression space of the cylinder, a first oil supply hole formed in the shaft potion, and a second oil supply hole that penetrates from the first oil supply hole to an outer circumferential surface of the eccentric portion; a roller slidingly coupled to the eccentric portion of the rotational shaft so as to be moved along an inner circumferential surface of the cylinder by the rotational shaft; and a vane slidingly coupled to the cylinder so as to divide the compression space into a plurality of compression chambers. The outer circumferential surface of the eccentric portion or an inner circumferential surface of the roller that faces the outer circumferential surface of the eccentric portion may be provided with an oil supply groove in communication with the second oil supply hole, and the oil supply groove may be eccentric in a circumferential direction with respect to the second oil supply hole. Accordingly, oil introduced into the oil supply groove through the second oil supply hole may be widely spread while flowing along the circumferential direction when the rotational shaft rotates.

The oil supply groove may extend from the second oil supply hole to one side along the circumferential direction, and a volume per unit area of the oil supply groove may decrease with an increase in distance from the second oil supply hole. This may allow oil to quickly flow from one end to another end of the oil supply groove.

A depth of the oil supply groove may vary along the circumferential direction, and the second oil supply hole may be formed at a deepest portion of the oil supply groove. As a result, oil may quickly flow in the oil supply groove due to a pressure difference.

Of an outer circumferential surface of the roller, the second oil supply hole may be formed at a portion at which a minimum surface pressure is applied. This may allow oil to be quickly introduced into the oil supply groove through the second oil supply hole.

Embodiments disclosed herein further provide a rotary compressor that may include a plurality of bearing plates; a cylinder provided between the plurality of bearing plates to form a compression space; a rotational shaft including a shaft portion that penetrates through the plurality of bearing plates, an eccentric portion that is accommodated in the compression space of the cylinder, a first oil supply hole formed in the shaft potion, and a second oil supply hole that penetrates from the first oil supply hole to an outer circumferential surface of the eccentric portion; a roller slidingly coupled to the eccentric portion of the rotational shaft so as to be moved along an inner circumferential surface of the cylinder by the rotational shaft; and a vane slidingly coupled to the cylinder so as to divide the compression space into a plurality of compression chambers. The outer circumferential surface of the eccentric portion or an inner circumferential surface of the roller that faces the outer circumferential surface of the eccentric portion may be provided with an oil supply groove. When a line that passes through an axial center of the rotational shaft and a center of the eccentric portion is referred to as a first virtual line, and a line that is orthogonal to the first virtual line and passes through the center of the eccentric potion is referred to a second virtual line, the second oil supply hole may be provided at a side at which the axial center of the rotational shaft is located with respect to the second virtual line in a manner of communicating with the oil supply groove. Accordingly, the second oil supply hole may be formed at a side with a lower surface pressure, allowing oil to be quickly supplied to the oil supply groove.

The second oil supply hole may be located at a rear side with respect to a rotational direction of the rotational shaft. As pressure decreases with an increase in distance from the second oil supply hole, oil introduced into the second oil supply hole may quickly flow to an end of the oil supply groove.

A depth of the oil supply groove may vary along the circumferential direction, and the second oil supply hole may be formed at the deepest portion of the oil supply groove. Accordingly, oil may quickly flow in the oil supply groove due to a pressure difference.

Of an outer circumferential surface of the roller, the second oil supply hole may be formed at a portion at which the minimum surface pressure is applied. This may allow oil to be quickly introduced into the oil supply groove through the second oil supply hole.

The cylinder may be provided with an inlet port and a vane slot formed along the circumferential direction with a predetermined interval therebetween, and a hinge groove may be formed on the outer circumferential surface of the roller. One or a first end of the vane may be slidingly coupled to the vane slot of the cylinder and another or a second end of the vane may be rotatably coupled to the hinge groove of the roller. This may allow the oil supply structure described above to be employed in the hinge vane type rotary compressor to thereby effectively reduce friction loss between the roller and the eccentric portion.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a plurality of bearing plates;

a cylinder provided between the plurality of bearing plates to form a compression space;

a rotational shaft including a shaft portion that penetrates through the plurality of bearing plates, an eccentric portion that is accommodated in the compression space of the cylinder, a first oil supply hole formed in the shaft portion, and a second oil supply hole that extends from the first oil supply hole to an outer circumferential surface of the eccentric portion;

a roller slidingly coupled to the eccentric portion of the rotational shaft so as to be moved along an inner circumferential surface of the cylinder by the rotational shaft; and a vane slidingly coupled to the cylinder so as to divide the compression space into a plurality of compression chambers, wherein the outer circumferential surface of the eccentric portion or an inner circumferential surface of the roller that faces the outer circumferential surface of the eccentric portion is provided with an oil supply groove formed along a circumferential direction to communicate with the second oil supply hole, and wherein the oil supply groove is formed such that a depth of a portion thereof adjacent to the second oil supply hole is greater than a portion thereof positioned a predetermined distance away from the second oil supply hole, wherein the oil supply groove comprises:

a first oil supply groove portion in which an end portion of the second oil supply hole is accommodated; and a second oil supply groove portion that extends from one end of the first oil supply groove portion in a rotational direction of the rotational shaft, wherein the second oil supply groove portion is provided at a position excluding a maximum load point formed between the outer circumferential surface of the eccentric portion and the inner circumferential surface of the roller.

2. The compressor of claim 1, wherein the second oil supply hole is located at an eccentric position with respect to a circumferential center of the oil supply groove.

3. The compressor of claim 1, wherein a depth of the oil supply groove decreases as a distance in the circumferential direction from the second oil supply hole increases.

4. The compressor of claim 1, wherein the second oil supply hole is located at a rear side of the oil supply groove with respect to a rotational direction of the rotational shaft.

5. The compressor of claim 1, wherein the oil supply groove comprises:

a first oil supply groove portion in which an end portion of the second oil supply hole is accommodated; and a second oil supply groove portion that extends from one end of the first oil supply groove portion in a rotational direction of the rotational shaft, wherein the second oil supply groove portion is eccentric to one direction along the circumferential direction with respect to the second oil supply hole, and wherein a circumferential length of the second oil supply groove portion is greater than a circumferential length of the first oil supply groove portion.

6. The compressor of claim 1, wherein the oil supply groove comprises:

a first oil supply groove portion in which an end portion of the second oil supply hole is accommodated; and a second oil supply groove portion that extends from one end of the first oil supply groove portion in a rotational direction of the rotational shaft, wherein the second oil supply groove portion is eccentric in one direction along the circumferential direction with respect to the second oil supply hole, and wherein a maximum depth of the second oil supply groove portion is less than a maximum depth of the first oil supply groove portion.

7. The compressor of claim 1, wherein the oil supply groove comprises:

a first oil supply groove portion in which an end portion of the second oil supply hole is accommodated; and a second oil supply groove portion that extends from one end of the first oil supply groove portion in a rotational direction of the rotational shaft, wherein the second oil supply groove portion is eccentric to one direction along the circumferential direction with respect to the second oil supply hole, and wherein a circumferential surface of the second oil supply groove portion is curved in an arcuate shape, and a center of an arc of the second oil supply groove portion is eccentric with respect to a center of a circle of the eccentric portion.

8. The compressor of claim 7, wherein the center of the arc of the second oil supply groove portion is located at an eccentric side of the eccentric portion rather than the center of the circle of the eccentric portion.

9. The compressor of claim 1, wherein the oil supply groove comprises:

a first oil supply groove portion in which an end portion of the second oil supply hole is accommodated; and a second oil supply groove portion that extends from one end of the first oil supply groove in a rotational direction of the rotational shaft, wherein the second oil supply groove portion is eccentric to one direction along the circumferential direction with respect to the second oil supply hole, and wherein a circumferential surface of the second oil supply groove portion is formed as at least one linear surface.

10. The compressor of claim 9, wherein the circumferential surface of the second oil supply groove portion is formed as a plurality of linear surfaces, and wherein the plurality of linear surfaces is formed such that a linear surface in contact with the first oil supply groove portion has a largest surface angle and a linear surface located farthest from the first oil supply groove portion has a smallest surface angle.

11. The compressor of claim 1, wherein the oil supply groove comprises:

a first oil supply groove portion in which an end portion of the second oil supply hole is accommodated; and a second oil supply groove portion that extends from one end of the first oil supply groove portion in a rotational direction of the rotational shaft, and wherein the second oil supply groove portion extends up to both axial sides of the eccentric portion and is open toward the plurality of bearing plates.

12. The compressor of claim 1, wherein the oil supply groove comprises:

a first oil supply groove portion in which an end portion of the second oil supply hole is accommodated; and a second oil supply groove portion that extends from one end of the first oil supply groove portion in a rotational direction of the rotational shaft, wherein the first oil supply groove portion extends up to at least one of both axial sides of the eccentric portion and is open toward the plurality of bearing plates facing each other, and wherein the second oil supply groove portion includes sealing surface portions that are respectively provided at both axial sides of the eccentric portion, an extended groove portion that extends in the circumferential direction between the sealing surface portions, and an open groove portion that extends from the extended groove portion and is open toward the plurality of bearing plates facing each other in an axial direction.

13. The compressor of claim 1, wherein the oil supply groove comprises:

a first oil supply groove portion in which an end portion of the second oil supply hole is accommodated;

a second oil supply groove portion that extends from one end of the first oil supply groove portion in a rotational direction of the rotational shaft; and at least one third oil supply groove portion that extends from the second oil supply groove portion in the circumferential direction, wherein a volume of the at least one third oil supply groove portion is less than a volume of the second oil supply groove portion.

14. The compressor of claim 1, wherein at least a portion of the oil supply groove is located at a side at which an axial center of the rotational shaft is located with respect to a second virtual line when a line that passes through the axial center of the rotational shaft and a center of the eccentric portion is referred to as a first virtual line, and a line that is orthogonal to the first virtual line and passes through the center of the eccentric portion is referred to as the second virtual line.

15. The compressor of claim 1, wherein the oil supply groove extends up to at least one of both axial sides of the eccentric portion and is open toward the plurality of bearing plates facing each other.

16. The compressor of claim 1, further comprising a bearing portion that extends from the shaft portion to be eccentric in a radial direction so as to be axially supported on the plurality of bearing plates, wherein when a point at which a first curve that defines an outer circumferential surface of the shaft portion and a second curve that defines the bearing portion intersect in axial projection is referred to as a first point, and a point at which a second virtual line that is orthogonal to a first virtual line that passes through an axial center of the shaft portion and passes through a center of the eccentric portion meets a third curve that defines the outer circumferential surface of the eccentric portion is referred to as a second point, the first point and the second point are spaced apart along the outer circumferential surface of the eccentric portion by a predetermined interval, the oil supply groove is formed between the first point and the second point, and the second oil supply hole is formed along a third virtual line that passes from the axial center of the shaft portion to the first point.

17. A rotary compressor, comprising:

a plurality of bearing plates;

a cylinder provided between the plurality of bearing plates to form a compression space;

a rotational shaft including a shaft portion that penetrates through the plurality of bearing plates, an eccentric portion that is accommodated in the compression space of the cylinder, a first oil supply hole formed in the shaft portion, and a second oil supply hole that extends from the first oil supply hole to an outer circumferential surface of the eccentric portion;

a roller slidingly coupled to the eccentric portion of the rotational shaft so as to be moved along an inner circumferential surface of the cylinder by the rotational shaft; and a vane slidingly coupled to the cylinder so as to divide the compression space into a plurality of compression chambers, wherein the outer circumferential surface of the eccentric portion or an inner circumferential surface of the roller that faces the outer circumferential surface of the eccentric portion is provided with an oil supply groove in communication with the second oil supply hole, and wherein the oil supply groove is eccentric in a circumferential direction with respect to the second oil supply hole; and a bearing portion that extends from the shaft portion to be eccentric in a radial direction so as to be axially supported on the plurality of bearing plates, wherein when a point at which a first curve that defines an outer circumferential surface of the shaft portion and a second curve that defines the bearing portion intersect in axial projection is referred to as a first point, and a point at which a second virtual line that is orthogonal to a first virtual line that passes through an axial center of the shaft portion and passes through a center of the eccentric portion meets a third curve that defines the outer circumferential surface of the eccentric portion is referred to as a second point, the first point and the second point are spaced apart along the outer circumferential surface of the eccentric portion by a predetermined interval, the oil supply groove is formed between the first point and the second point, and the second oil supply hole is formed along a third virtual line that passes from the axial center of the shaft portion to the first point.

18. The compressor of claim 17, wherein the oil supply groove extends from the second oil supply hole to one side along the circumferential direction, and a volume per unit area of the oil supply groove decreases with an increase in distance from the second oil supply hole.

19. The compressor of claim 17, wherein the cylinder is provided with an inlet port and a vane slot formed along the circumferential direction with a predetermined interval therebetween, wherein a hinge groove is formed on an outer circumferential surface of the roller, and wherein a first end of the vane is slidingly coupled to the vane slot of the cylinder, and a second end of the vane is rotatably coupled to the hinge groove of the roller.

20. A rotary compressor, comprising:

a plurality of bearing plates;

a cylinder provided between the plurality of bearing plates to form a compression space;

a rotational shaft including a shaft portion that penetrates through the plurality of bearing plates, an eccentric portion that is accommodated in the compression space of the cylinder, a first oil supply hole formed in the shaft portion, and a second oil supply hole that extends from the first oil supply hole to an outer circumferential surface of the eccentric portion;

a roller slidingly coupled to the eccentric portion of the rotational shaft so as to be moved along an inner circumferential surface of the cylinder by the rotational shaft; and a vane slidingly coupled to the cylinder so as to divide the compression space into a plurality of compression chambers, wherein the outer circumferential surface of the eccentric portion or an inner circumferential surface of the roller that faces the outer circumferential surface of the eccentric portion is provided with an oil supply groove formed along a circumferential direction to communicate with the second oil supply hole, wherein the oil supply groove comprises:

a first oil supply groove portion in which an end portion of the second oil supply hole is accommodated; and a second oil supply groove portion that extends from one end of the first oil supply groove portion in a rotational direction of the rotational shaft, wherein the second oil supply groove portion is eccentric to one direction along the circumferential direction with respect to the second oil supply hole, wherein a circumferential length of the second oil supply groove portion is greater than a circumferential length of the first oil supply groove portion, wherein a depth of the second oil supply groove portion decreases as a distance in the circumferential direction from the second oil supply hole increases, and wherein the second oil supply groove portion extends up to both axial sides of the eccentric portion and is open toward the plurality of bearing plates.

* * * * *